US007861834B2

(12) United States Patent
Gorga et al.

(10) Patent No.: US 7,861,834 B2
(45) Date of Patent: Jan. 4, 2011

(54) RETRACTABLE WHEEL SYSTEM FOR TOWABLE BAGGAGE

(75) Inventors: Aaron Gorga, St. Louis, MO (US); Chris W. Cicenas, Pataskala, OH (US); Joseph M. Lehman, New Albany, OH (US)

(73) Assignee: TRG Accessories, L.L.C., St. Louis, MO (US)

( * ) Notice: Subject to any disclaimer, the term of this patent is extended or adjusted under 35 U.S.C. 154(b) by 404 days.

(21) Appl. No.: 11/966,753

(22) Filed: Dec. 28, 2007

(65) Prior Publication Data

US 2009/0166140 A1 Jul. 2, 2009

(51) Int. Cl.
*A45C 5/00* (2006.01)

(52) U.S. Cl. ..... 190/18 A; 190/115; 280/47.371; 280/655; 280/37

(58) Field of Classification Search ..... 190/18 A, 190/115; 280/47.371, 655, 37
See application file for complete search history.

(56) References Cited

U.S. PATENT DOCUMENTS

| | | | | |
|---|---|---|---|---|
| 440,278 | A | 11/1890 | Payntar | |
| 1,756,775 | A | 7/1927 | Winning | |
| 4,217,675 | A | 8/1980 | Haft | |
| 4,575,109 | A * | 3/1986 | Cowdery | 280/37 |
| 4,773,123 | A | 9/1988 | Yu | |
| 4,822,071 | A | 4/1989 | Widegren | |
| 4,844,215 | A | 7/1989 | Ambasz | |
| 4,846,493 | A | 7/1989 | Mason | |
| 4,915,402 | A | 4/1990 | Brinker | |
| 5,154,265 | A | 10/1992 | Capistrant | |
| 5,228,706 | A | 7/1993 | Boville | |
| 5,249,438 | A | 10/1993 | Rhaney et al. | |
| 5,478,097 | A | 12/1995 | Forma | |
| 5,505,471 | A | 4/1996 | Cheng | |
| 5,524,737 | A | 6/1996 | Wang | |
| 5,743,542 | A | 4/1998 | Mast et al. | |
| 5,758,752 | A | 6/1998 | King et al. | |
| 5,956,805 | A | 9/1999 | Huang | |
| 6,021,874 | A | 2/2000 | Nykoluk | |
| 6,056,301 | A | 5/2000 | Berliner et al. | |
| 6,059,078 | A | 5/2000 | Nykoluk | |
| 6,196,561 | B1 | 3/2001 | Trassinelli | |
| 6,220,411 | B1 | 4/2001 | Scicluna et al. | |

(Continued)

FOREIGN PATENT DOCUMENTS

| | | | |
|---|---|---|---|
| WO | 2006045107 | A2 | 4/2006 |

OTHER PUBLICATIONS

International Search Report of PCT/US2008/065272; Sep. 3, 2008; 14 pages.

*Primary Examiner*—Anthony Stashick
*Assistant Examiner*—Cynthia F Collado
(74) *Attorney, Agent, or Firm*—Armstrong Teasdale LLP

(57) ABSTRACT

A towable baggage item is provided. The towable baggage item includes a body defining a storage compartment, the storage compartment configured to receive and carry objects. The towable baggage item also includes a retractable towing member coupled to the body. Furthermore, the towable baggage item also includes a retractable wheel assembly responsive to a position of the retractable towing member, wherein the retractable wheel assembly comprises at least one wheel and an actuator operatively coupled to each the wheel, wherein the actuator is movable along a first linear axis to extend and retract the wheel along a second linear axis different from the first linear axis.

1 Claim, 30 Drawing Sheets

U.S. PATENT DOCUMENTS

| | | | | |
|---|---|---|---|---|
| 6,289,554 | B1 | 9/2001 | Wang | |
| 6,305,513 | B1 | 10/2001 | Lu | |
| 6,367,602 | B1 | 4/2002 | Chang | |
| 6,390,259 | B1 | 5/2002 | Lu | |
| 6,408,997 | B1 | 6/2002 | Chen | |
| 6,520,514 | B2 | 2/2003 | Clegg | |
| 6,533,087 | B1 | 3/2003 | Chen | |
| 6,575,272 | B1 | 6/2003 | Krulik et al. | |
| 6,612,411 | B2 | 9/2003 | Nykoluk et al. | |
| 6,802,515 | B2 * | 10/2004 | Sorenson et al. | 280/47.26 |
| 7,021,437 | B2 | 4/2006 | Ghiassi | |
| 7,066,311 | B2 | 6/2006 | O'Shea | |
| 7,086,510 | B2 | 8/2006 | Smith et al. | |
| 7,093,700 | B2 | 8/2006 | Krulik et al. | |
| 7,341,164 | B2 * | 3/2008 | Barquist et al. | 220/629 |
| 2002/0040834 | A1 | 4/2002 | Chen | |
| 2002/0125088 | A1 | 9/2002 | Nykoluk | |
| 2004/0163910 | A1 | 8/2004 | Lee | |
| 2006/0001243 | A1 | 1/2006 | Hsu | |
| 2006/0037823 | A1 | 2/2006 | Peterson et al. | |
| 2006/0070837 | A1 | 4/2006 | King et al. | |
| 2006/0124417 | A1 | 6/2006 | O'Shea et al. | |
| 2007/0278755 | A1 * | 12/2007 | Jack | 280/37 |

* cited by examiner

RETRACTABLE WHEEL SYSTEM FOR TOWABLE BAGGAGE

BACKGROUND OF THE INVENTION

This invention relates generally to wheeled baggage items having towing handles for rolling the baggage along the ground, and more particularly, to retractable towing wheel assemblies for towable baggage.

Various types of bags, from luggage items to briefcases and backpacks, now include wheels and a towing handle which allow the bags to be pulled along a surface rather than being carried above the ground. The towing handle is typically located on an end of the bag opposite the wheels, and the bag is pulled along the ground in an inclined position. Such towable baggage items can be very convenient and are now popular. Retractable wheel systems have also been developed for such towable bags, although improvements are desired.

BRIEF DESCRIPTION OF THE INVENTION

In one embodiment, a towable baggage item is provided. The towable baggage item includes a body defining a storage compartment, the storage compartment configured to receive and carry objects. The towable baggage item also includes a retractable towing member coupled to the body. Furthermore, the towable baggage item also includes a retractable wheel assembly responsive to a position of the retractable towing member, wherein the retractable wheel assembly comprises at least one wheel and an actuator operatively coupled to each the wheel, wherein the actuator is movable along a first linear axis to extend and retract the wheel along a second linear axis different from the first linear axis.

Optionally, the second linear axis is substantially perpendicular to the first linear axis and the first linear axis is parallel to a rotational axis of the wheel. The at least one wheel may include a first wheel and a second wheel, the actuator being coupled to both of the first wheel and the second wheel. The actuator may simultaneously move the first wheel and the second wheel to an extended position when moved along the first axis in a first direction, and wherein the actuator may simultaneously move the first and second wheel to a retracted position when moved along the first axis in a second direction opposite to the first direction. The sliding actuator may include a first wheel carrier actuation slot for positioning the first wheel, and a second wheel carrier actuation slot for positioning the second wheel, wherein the first and second wheel actuation slots extend obliquely to the first axis.

Optionally, the towing member may include a first support pole mounted stationary to the body, a second support pole in a telescoping relationship with the first support pole and selectively positionable with respect to the first pole, and an actuator tab coupled to and movable with the second support pole, wherein a position of the actuator tab may determine the position of the sliding actuator along the first axis. The sliding actuator may include a channel configured to traverse the sliding actuator along a nonlinear path, thereby causing the sliding actuator to move along the first axis. The towing member may include a first pole and a second pole spaced from one another and arranged generally parallel to one another. The sliding actuator may be operatively connected to only one of the first pole and the second pole.

Optionally, the at least one wheel may be movable between an extended position and a retracted position without utilizing a spring assisted element. The retractable wheel assembly may further include a bottom frame defining a first and a second wheel well, the actuator slidably positionable on the bottom frame along the first axis. The retractable wheel assembly may further include first and second wheel carriers coupled to the actuator, the bottom frame defining guide slots for moving the first and second wheel carriers along the second axis. The wheel carrier may include a body and a slot in the body, the slot aligned with the second axis and facilitating motion of the carrier along the second axis as the actuator is moved along the first axis. The wheel carrier may have a convex portion and a concave portion extending along the second axis.

Optionally, the towable baggage item may further include a first wheel well and a second wheel well, wherein the sliding actuator spans substantially an entire distance between the first and second wheel wells. The sliding actuator may include a first end edge and a second end edge and the sliding actuator may move along the first axis between an extended position and a retracted position, wherein the first end edge is moved toward the first wheel well in the retracted position, and wherein the second end edge is moved toward the second wheel well in the extended position.

Optionally, the actuator may be self-locking when the wheels are extended and retracted. Furthermore, the actuator may be asymmetrical. The actuator also may include a plate defining a first slot extending along the first axis and allowing the actuator to move along the first axis, a second slot extending obliquely to the first slot and allowing the wheel carrier to move along the second axis, and a third slot defining a nonlinear path engaged by the towing member to move the actuator along the first axis. The body may define one of a backpack, a suitcase, a briefcase, a computer bag, a duffel bag, an upright bag, a sports bag, a golf bag, and a golf bag carrier.

In another embodiment, a towable baggage item is provided. The towable baggage item includes a body defining a storage compartment configured to receive and carry objects, a retractable towing member coupled to the body and positionable between an extended towing position and a retracted storage position relative to the body, first and second wheels coupled to the body for towing of the bag on the first and second wheels with the retractable towing member in the towing position, and a wheel actuator responsive to the position of the towing member, wherein the wheel actuator comprises a unitary member operatively coupled to the first wheel, the second wheel, and the towing member. The actuator is movable by the towing member between a first position that simultaneously extends the first and second wheels for towing of the body to a second position that simultaneously retracts the first and second wheels to a storage position wherein the first and second wheels are generally concealed when the body is in an upright position.

Optionally, the actuator is slidably movable along a linear axis, wherein the linear axis is parallel to the rotational axis of the first and second wheels. The actuator may include a plate defining a first pair of slots extending along the linear axis and allowing the actuator to move, a second pair of slots extending obliquely to the first pair of slots and allowing the first and second wheels to be extended and retracted as the actuator is moved, and a third slot defining a nonlinear path engaged by the towing member to move the actuator along the linear axis.

In yet another exemplary embodiment, a towable baggage item is provided. The towable baggage item includes a body defining a storage compartment configured to receive and carry objects, a retractable towing member coupled to the body and comprising first and second telescoping poles that are positionable between an extended towing position and a retracted storage position relative to the body, first and second wheels coupled to the body for towing of the bag on the first and second wheels with the retractable towing member in the towing position, and a sliding wheel actuator responsive to the position of at least one of the telescoping poles, wherein the wheel actuator comprises a plate operatively coupled to the first wheel, the second wheel, and the towing member. The actuator is slidably movable in a first direction by the telescoping pole to first position that extends the first and second wheels for towing of the body when the telescoping pole is extended, and wherein the actuator is slidably movable by the telescoping pole in a second direction that retracts the first and second wheels to a retracted storage position when the telescoping pole is retracted.

Optionally, the actuator is slidably movable along a linear axis, wherein the linear axis is parallel to the rotational axis of the first and second wheels. The actuator may include a plate defining a first pair of slots extending along the linear axis and allowing the actuator to move, a second pair of slots extending obliquely to the first pair of slots and allowing the first and second wheels to be extended and retracted as the actuator is moved, and a third slot defining a nonlinear path engaged by the towing member to move the actuator along the linear axis.

In yet another exemplary embodiment, a towable baggage item is provided. The towable baggage item includes a body defining a storage compartment configured to receive and carry objects, a retractable towing member coupled to the body and comprising first and second telescoping poles that are positionable between an extended towing position and a retracted storage position relative to the body, first and second wheels coupled to the body for towing of the bag on the first and second wheels with the retractable towing member in the towing position, a sliding wheel actuator responsive to the position of at least one of the telescoping poles, wherein the wheel actuator comprises a plate operatively coupled to the first wheel, the second wheel, and the towing member, and first and second wheel carriers coupling the first and second wheels, respectively, to the sliding wheel actuator. The actuator is slidably movable along a first axis by the telescoping pole as it is extended and retracted, and wherein the actuator is adapted to slidably move both the first and second wheel carriers along an axis different from the first axis as the actuator is moved along the first axis.

Optionally, the first axis may be a linear axis extending between the first and second wheels. Also, the first axis may be parallel to the rotational axis of the first and second wheels. The actuator may include a plate defining a first pair of slots extending along the linear axis and allowing the actuator to move, a second pair of slots extending obliquely to the first pair of slots and allowing the first and second wheels to be extended and retracted as the actuator is moved, and a third slot defining a nonlinear path engaged by the towing member to move the actuator along the linear axis.

In yet another embodiment, a towable baggage item is provided. The towable baggage item includes a body configured to receive and carry objects, a telescoping towing member connected to the body, the towing member telescoping between retracted and extended positions relative to the body, two wheel wells coupled to the body, two wheel assemblies connected to the body proximate the respective wheel wells, each of the two wheel assemblies comprising a wheel and a wheel carrier being movable between stored and towing positions relative to the wheel housing by linearly sliding the wheel carrier relative to the body, the wheel at least partially protruding from the cavity of the wheel well when in the towing position and being positioned within the wheel well when in the stored position, the wheel assemblies being connected to the towing member in a manner such that the wheel of each of the wheel assemblies moves into the towing position in response to the towing member being moved from the retracted position to the extended position and such that the wheel of each of the wheel assemblies moves into the stored position in response to the towing member being moved from the extended position to the retracted position, wherein the wheel assemblies are moved into the towing and stored position without a spring assisted element.

Optionally, the two wheel assemblies may be moved by a single actuator. Furthermore, the single actuator may be slideable about a linear axis that is different from an axis of movement of the wheel carriers.

DETAILED DESCRIPTION OF THE INVENTION

The present invention, as described in relation to exemplary embodiments set forth below, provides a retractable wheel assembly for baggage items, and particularly for luggage items, which overcomes difficulties and disadvantages in the art. In order to appreciate the present invention to its fullest extent, the disclosure herein will be segmented into different segments, wherein Part I introduces conventional towable baggage items and problems in the art; and Part II discloses exemplary embodiments of the invention that overcome the problems discussed in Part I.

I. Introduction to the Invention

A variety of baggage items, including suitcase and luggage pieces, duffel bags, backpacks, and sports bags such as equipment bags, golf bags and golf bag carriers, to name a few, are now provided with wheels and towing handles allowing the bags to conveniently be moved along supporting surfaces without having to lift the bag off the ground.

Conventional towable bags are prone, however, to certain disadvantages. For example, the wheels tend to become dirty in use, and accumulated dirt and grime from the wheels may soil the outer contours of the bag adjacent the wheels. Aside from being unsightly, when the bag is lifted by the user, the dirty wheels and/or adjacent areas of the bag can soil other items, such as, for example, clothes that the user is wearing when lifting the bag; beds, sofas and other furniture that the bag is placed upon for packing or unpacking; upholstery and interior surfaces of vehicles that the bag is transported in; and other items that the bag is brought into contact with. Such problems are particularly acute when the wheels of the bag are pulled across wet and/or unclean surfaces, including but not limited to outdoor terrain. Mud and grime that becomes caked on the wheels and adjacent areas of the bag can be difficult to clean from the bag, as well as other items that the dirty wheels and bag may contact.

Some attempt has been made to develop wheel assemblies that can be retracted into a portion of a bag to avoid these and other problems. U.S. Pat. No. 6,612,411, for example, discloses a method and device for extending and retracting the wheels of a piece of towable baggage that address, with some success, problems associated with unsightliness and uncleanliness of the wheels and associated areas of towable baggage. The retractable wheel assemblies of this patents, and other known retractable wheel assemblies, however, are disadvantaged and improvements are desired for the reasons set forth below.

Figure 1:
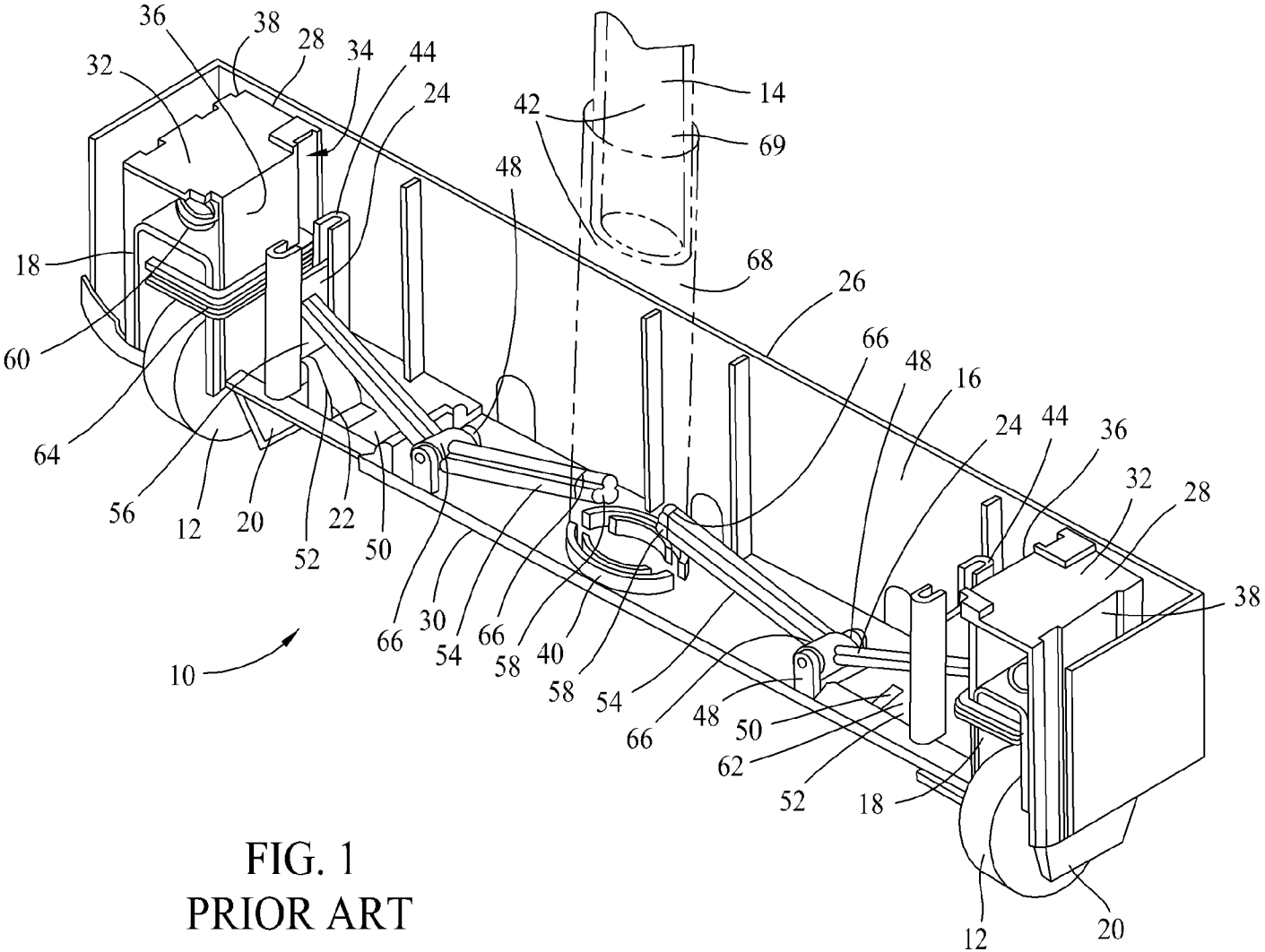
FIG. 1 PRIOR ART
FIG. 1 is a perspective view of a prior art device for extending and retracting the wheels of a piece of towable baggage.

FIG. 1 illustrates one example of a prior art retractable wheel assembly for towable baggage, and more specifically illustrates a base assembly 10 for a piece of towable baggage as disclosed in U.S. Pat. No. 6,612,411. The base assembly 10 provides structure for attachment of towing wheels 12 to the towable baggage and as explained in U.S. Pat. No. 6,612,411, the wheels 12 are movable between stored and towing positions when a towing member 14 is moved between an extended and retracted position. As such, when the towing member 14 is extended, the wheels 12 are also extended for use, and when the towing member 14 is retracted, the wheels 12 are retracted to a location interior to the base assembly 10. The base assembly 10 includes various components that operate to move the towing wheels 12 between towing and stored positions in response to movement of the towing member 14 between extended and retracted positions. The components include, as shown in FIG. 1, a main assembly housing 16, a pair of mirror-image wheel mounts 18 connecting the towing wheels 12 to the main assembly housing 16, a pair of feet 20, a locking assembly 22, and a linkage assembly 24.

The main assembly housing 16 is a rectangular shell that is open at its top 26, and two generally rectangular, thin walled wheel mount receptacles 28 are positioned at opposite ends of the main assembly housing 16 and extend upwardly from a bottom wall 30 of the main assembly housing 16. The walls of the wheel mount receptacles 28 are closed at their tops by a top wall 32 and are open to the exterior of the piece of baggage through the bottom wall 30 of the main assembly housing 16. A pair of vertical slots 34 extend through mutually opposed inboard walls 36 of the wheel mount receptacles 28. Each of the wheel mount receptacles has a pair of vertically oriented guide channels formed in an interior surface of an outboard wall 38.

The main assembly housing 16 also includes a centrally positioned towing member mount 40 that protrudes upwardly from the bottom wall 30 of the main assembly housing and provides a site for the retractable towing member 14 having telescoping tubular sections 42. A pair of lock release member guides 44 and a pair of arm mounts 48 also protrude upwardly from the bottom wall 30 of the main assembly housing 16. A rectangular opening 50 extends through the bottom wall 30 of the main assembly housing 16 adjacent each of the lock release member guides 44.

The locking assembly 22 of the main assembly housing 16 of the piece of baggage 50 comprises a pair of mirror image, spring loaded locking members 52 and a pair of locking member guides. The locking members 52 and locking member guides are positioned on either side of the towing member 14 so as to respectively retain or release the towing wheels 12 for movement relative to the main assembly housing 16.

The linkage assembly 24 includes a pair of mirror-image arms 54 and a pair of mirror image lock release members 56. Each of the pair of arms 54 is identical to the other and is located on either side of the towing member 14. Each of the arms 54 has a pair of tines that form a forked end of the arm. The length of each arm 54 is formed as a bell crank that extends from the forked end to a free end 58.

Additionally, a vertically oriented compression spring is positioned on posts 60 in each of the wheel mounts 18 where the springs will engage with the top walls 32 in the interior of the wheel mount receptacles 28 and act to force the wheel mounts 18 downward relative to the main assembly housing 16. The wheel mounts 18 slidably engage guide channels of the outboard walls 38 of the wheel mount receptacles. As the wheel mounts 18 are moved into the wheel mount receptacles 28 of the main assembly housing 16 against the force of the compression springs, resilient tabs of the wheel mount receptacles 28 eventually pass over notches in the front walls of the wheel mounts 18 to prevent the wheel mounts 18 from moving back out of the wheel mount receptacles 28. The locking member guides of the locking assembly 22 are rigidly connected to the main assembly housing 16 from beneath the main assembly housing 16, with the release tabs 62 of the locking members 52 projecting upwardly through the rectangular openings 50 of the main assembly housing 16.

The linkage assembly 24 is assembled to the main assembly housing 16 by passing tines 64 of the forked end of each of the arms 54 through the vertical slots in the respective wheel mount receptacles 28 and through the arm slots of the corresponding wheel mount 18. To do this, locking protrusions of the locking members 52 are forced out of locking indentations in the wheel mounts 18 and the wheel mounts are forced upwardly into the wheel mount receptacles 28. Each lock release member 56 is then positioned such that one of the arms 54 passes through a slit in the lock release member 56. Side edges of each lock release member 56 are then slid into the corresponding lock release guides 44 of the main assembly housing 16. Finally, the arms 54 are brought into a position such that a pivot journal 66 of each of the arms 54 is aligned with one of the arm mounts 48 of the main assembly housing 16 where a pivot pin is then used to pivotally connect the arm to the main assembly housing 16.

Once the base assembly 10 is assembled as described above, the base assembly is fastened to the pack portion of the piece of baggage. A base section 68 of the towing member 14 is then connected by a pin type fastener to the towing member mount 40 of the main assembly housing 16 with the free ends 58 of the arms 54 of the linkage assembly 24 extending through the slots 66 of the base section 68 of the towing member 14.

When assembled as such, the towing wheels 12 of the piece of baggage 50 move relative to the remainder of the base assembly 10 in response to movement of the towing member 14 between the extended and retracted positions. When the towing member 14 is in an extended position, the towing wheels are positioned in a towing position wherein the wheel mounts 18 are positioned relative to the wheel mount receptacles 28 of the main assembly housing 16 where the locking protrusions of the locking members 52 engage the locking indentations of the wheel mounts 18 and the towing wheels 12 partially protrude from the wheel mount receptacles 28. Thus, in the towing position, the towing wheels 12 are locked in position relative to the main assembly housing 16 of the base assembly 10.

With the towing wheels 12 in the towing position, the piece of baggage can be towed along the ground by tilting the piece of baggage onto the towing wheels 12 using the towing member 14.

When the towing member 14 is moved back into a retracted position, a second section 69 of the towing member 14 slides down into the base section 68 of the towing member where it contacts the free ends 58 of the arms of the linkage assembly 24 and moves the free ends 58 downwardly and causes the forked ends of the arms 54 to raise as the arms 54 pivot about the arm mounts 48. As the forked ends of the arms 54 are raised, the arms 54 exert force on the locking members 52 which causes them to move toward each other and disengages the locking protrusions of the locking members 52 from the locking indentations of the wheel mounts 18.

As the second section 69 of the towing member 14 slides further down into the base section 68 of the towing member, the free ends 58 of the arms 54 of the linkage assembly 24 continue to move downward causing further upward movement of the forked ends of the arms 54. This causes the tines 64 of the forked ends of the arms 54 to engage the top walls of the wheel mounts 18 and move the wheel mounts 18 upward into the wheel mount receptacles 28 of the main assembly housing 16 against the force of the compression springs.

When the towing member 14 is completely retracted, the wheel mounts 18 are held by the arms 54 of the linkage assembly 24 in a position far enough into the receptacles 28 of the main assembly housing 16 such that the towing wheels are moved to a stored position wherein each towing wheel 12 is positioned completely within the wheel mount receptacle 28. Thus, with the towing member 14 retracted, the towing wheels 12 are in the stored position and the piece of baggage can be carried by hand, stored, or otherwise utilized without the risk of the towing wheels marring clothing or upholstery. Furthermore, when the towing wheels 12 are in the stored position, the towing wheels can not easily be seen and the aesthetic appearance of the piece of baggage 50 is thereby improved.

To return the towing wheels 12 of the piece of baggage 50 to the towing position, the towing member 14 is simply extended from the piece of baggage. When this is done, the second section 69 of the towing member 14 no longer holds the free ends of the arms 54 of the linkage assembly 24 and the springs acting upon the wheel mount receptacles 28 cause the wheel mounts 18 and the towing wheels 12 to move downward into the towing position. As this occurs, the arms 54 engage edges of the lock release members 56, thereby causing the lock release members 56 to move downward in the lock release member guides 44. The lock release members 56, in turn, engage the locking members 52, causing the locking members to move toward each other. Movement of the locking members 52 toward one another allows protrusions of the lock release members 56 to pass the under the portions of the locking members 52 where the locking members can then move apart from each other to reengage the locking protrusions of the locking members 52 into the locking indentations of the wheel mounts 18.

The base assembly 10, while being effective to extend and retract the towing wheels 12, is difficult and costly to implement in an economical manner, and also is prone to reliability issues in use. Separate and independent locking members 22, actuator linkage assemblies 24, and wheel mounts 18 are provided to extend or retract the respective wheels 12, resulting in multiple mechanical mechanisms that are each vulnerable to jamming, failure and/or damage that may render the device inoperable to extend or retract one or both of the wheels 12. Further, because each of the locking members and linkages associated with each wheel 12 includes multiple, movable parts and spring loaded elements, and further because of each of the wheel mounts 18 is also spring loaded, the base assembly 10 is vulnerable to a large number of different mechanical misalignment and failure conditions associated with the actuation and locking of each of the towing wheels 12 that raise reliability issues in use.

Furthermore, because of the number of parts and the intricacy of the pivotal linkage, sliding spring-loaded locking mechanisms, and sliding spring loaded wheel mounts, the base assembly 10 can be especially difficult to assemble and/or repair in a cost effective, efficient, and reliable manner.

It would therefore be desirable to provide a lower cost retractable wheel assembly for towable baggage items that has fewer component parts, is easier to assemble and service, and that is more reliable than the assembly 10.

While the base assembly 10 of U.S. Pat. No. 6,612,411 is specifically discussed, it is believed to be representative of other known retractable wheel assemblies for towable bags that are prone to similar problems and disadvantages.

II. Exemplary Embodiments of the Invention

Figure 2:
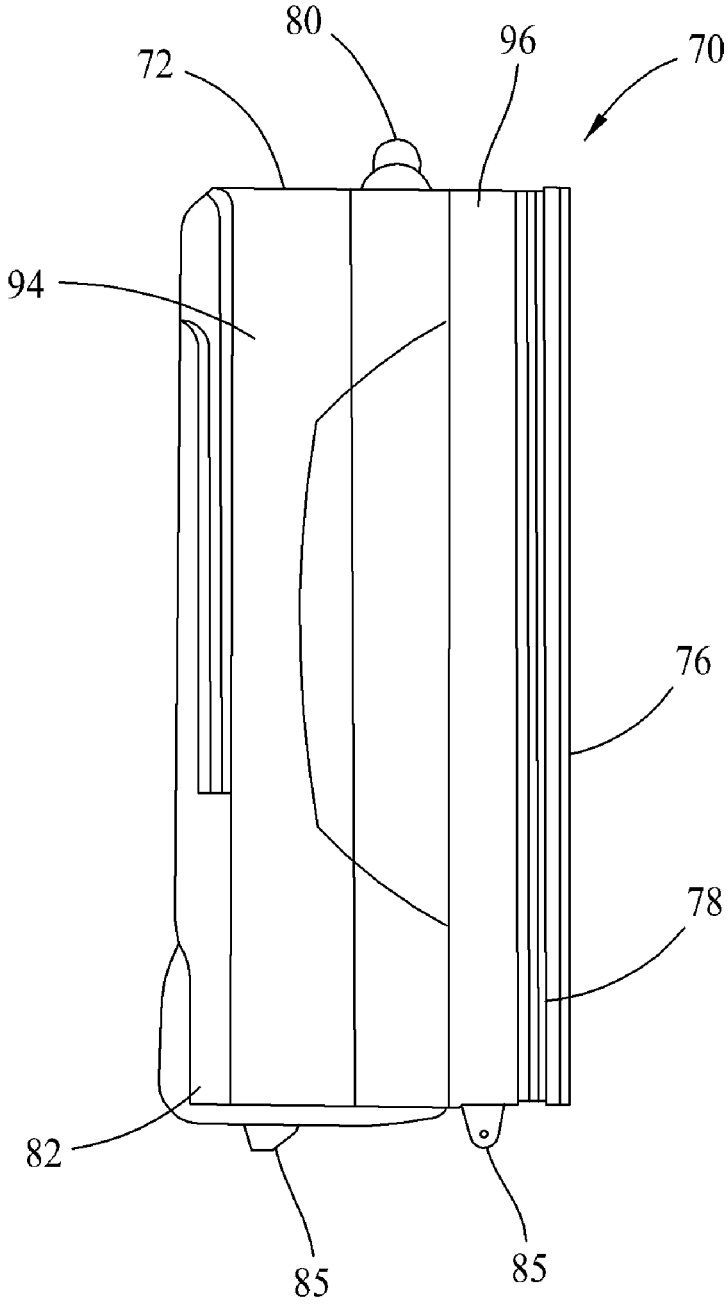
FIG. 2 is a side elevational view of an exemplary towable baggage item formed in accordance with an exemplary embodiment of the present invention.
Figure 3:
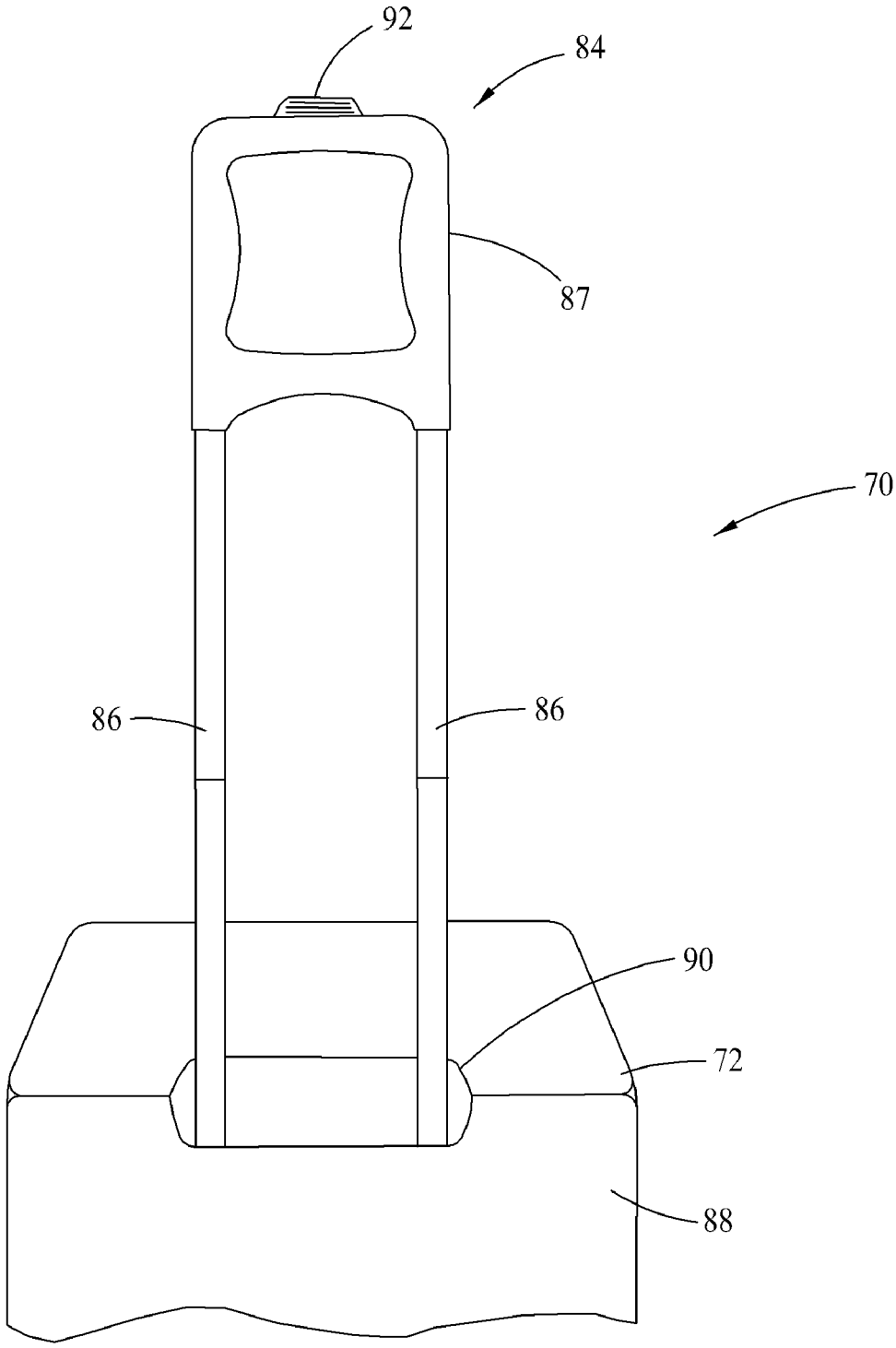
FIG. 3 is a partial perspective view of the towable baggage item shown in FIG. 2 including an exemplary towing handle in an extended position.
Figure 4:
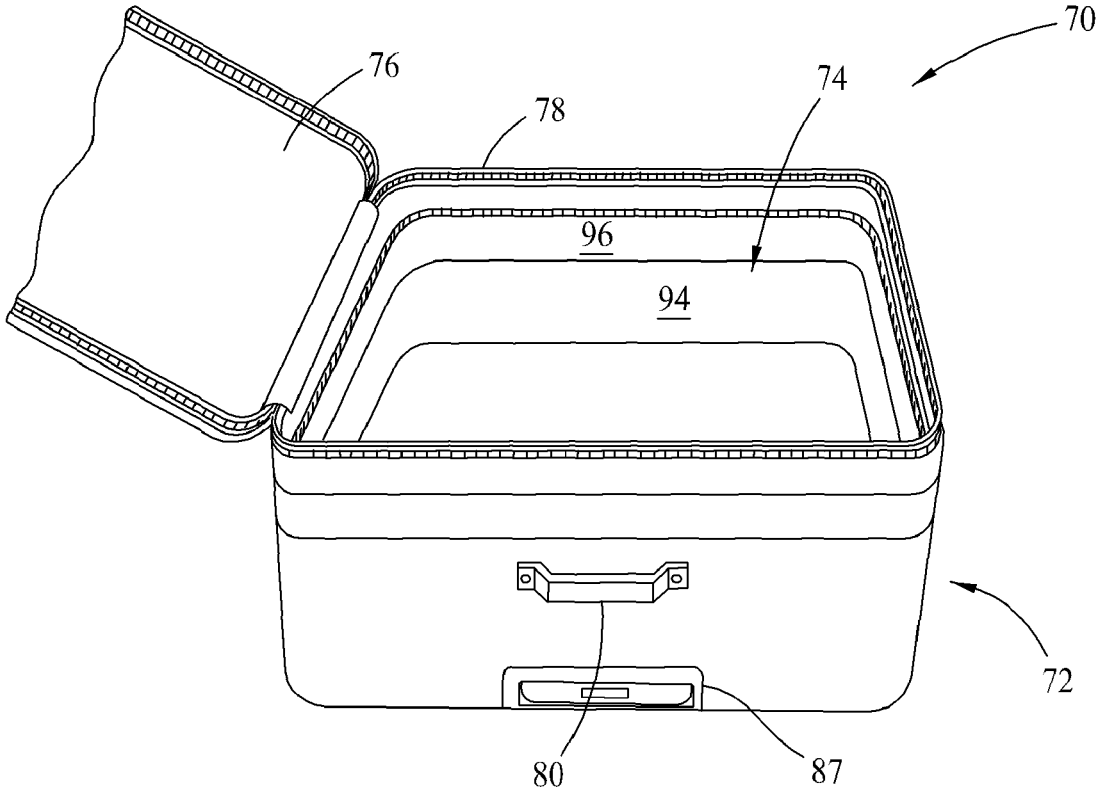
FIG. 4 is a perspective view of the towable baggage item shown in FIGS. 2 and 3.

Referring now to FIGS. 2-4, an exemplary towable baggage item 70 is shown, the type of which may benefit from the retractable wheel assembly of the present invention as described hereinbelow. FIG. 2 is a side elevational view of the exemplary towable baggage item 70 formed in accordance with an exemplary embodiment of the present invention. FIG. 3 is a partial plan view of the towable baggage item 70 shown in FIG. 2 including an exemplary towing handle in an extended position. FIG. 4 is a perspective view of the towable baggage item 70 shown in FIGS. 2 and 3.

The baggage item 70 includes a body 72 defining a compartment 74 (see FIG. 4) with one or more points of access for receiving personal effects and items a traveler may need for a trip away from home, such as clothes, shoes, toiletries, etc. The compartment 74 may, as desired, be subdivided into smaller compartments in a further, and/or alternative embodiment. That is, the compartment 74 may be considered a primary storage compartment, with secondary storage compartments also being provided through segmenting of the compartment 74 into smaller portions, or alternatively by being provided elsewhere in the construction of the bag.

A closure element 76 (shown in an opened position in FIG. 4 and a closed position in FIG. 2) is selectively positionable relatively to the body 72 in a known manner for packing and unpacking of the compartment 74 with items. The closure element 76 may comprise a fabric panel hingedly attached to the body 72 along one edge thereof as shown in FIG. 4, and a zipper 78, for example, that is accessible from an exterior of the body 72 to open or close the closure element 76. In other alternative embodiments, other closure elements may likewise be used, along with known alternatives to zipper 78, including but not limited to foldable panels and hook and loop fasteners.

The body 72 may, for example, be sized and dimensioned appropriately for transport in an aircraft or vehicle and for being carried by hand via a carrying handle 80, and may include one or more wheels 82 on a lower edge thereof that allow the body 72 to be rolled along a surface when desired. Accordingly, a towing handle system 84 may also be provided and coupled to the body 72 as desired for towing the baggage item 70 by hand along a surface via the wheels 82. Also, a plurality of feet 85 may be included to protect a bottom wall of the baggage item 70 when the item 70 is positioned to rest on the bottom wall.

FIG. 3 is a partial perspective view of the towable baggage item 70 including an exemplary towing handle system 84 in an extended position. The towing handle system 84 may include a pair of telescoping support posts or poles 86 and a towing handle assembly 87 coupled to an end of the support poles 86. The support poles 86 extend generally alongside a back panel 88, and are fixedly mounted to the baggage item 70 within a recess 90. In accordance with known telescoping supports, the support poles 86 include sliding support members arranged in a concentric fashion, and the sliding members include spring loaded pins (not shown) which engage apertures (not shown) to lock the supports in an extended position (FIG. 3) and a retracted position (FIG. 2). The towing handle assembly 87 may include a push button 92 that, among other things, releases the pins from the apertures in the support poles 86 and allow the support poles 86 to telescope to the extended or retracted positions. The support poles 86 may be fabricated from, for example, aluminum, according to a known process.

Although the towing handle system 84 is shown including two support poles 86, in alternative embodiments, handle system 84 may include one support pole or a plurality of support poles.

While the body 72 in an illustrative embodiment defines a substantially rectangular luggage bag in the form of an upright suitcase as shown in FIG. 2, it is understood that the body 72 may alternatively assume various alternative shapes and styles. The different types of baggage and luggage items may include, but are not limited to, other types of suitcases, backpacks, briefcases, duffel bags and the like. Additionally, carrying handles, straps, shoulder straps, and the like may be provided as appropriate for different types of bags.

Exterior surfaces of the body 72 may include fabric panels and the like to form a soft-sided construction in an exemplary embodiment, as opposed to comparatively rigid, hard-shelled constructions that have also been conventionally used to fabricate baggage items. In an exemplary embodiment, the body 72 is defined at least in part by a first frame 94, sometimes referred to as a back frame, and a second frame 96, sometimes referred to as a front frame, each defining a portion of the baggage item 70. The frames 94, 96 are fabricated from known materials and impart, for example, a freestanding rectangular shape and form to the baggage item 70. The frames 94, 96 may be fabricated in a thin walled, cellular structure, sometimes referred to as a honeycomb structure, for weight reduction purposes. Additionally, the frames 94, 96 may be wrapped with fabrics, linings and the like to match remaining portions of the baggage item 70 on the interior and the exterior. In alternative embodiments, the bag may be configured as a collapsible bag and one or both of the frames may be omitted.

Figure 5:
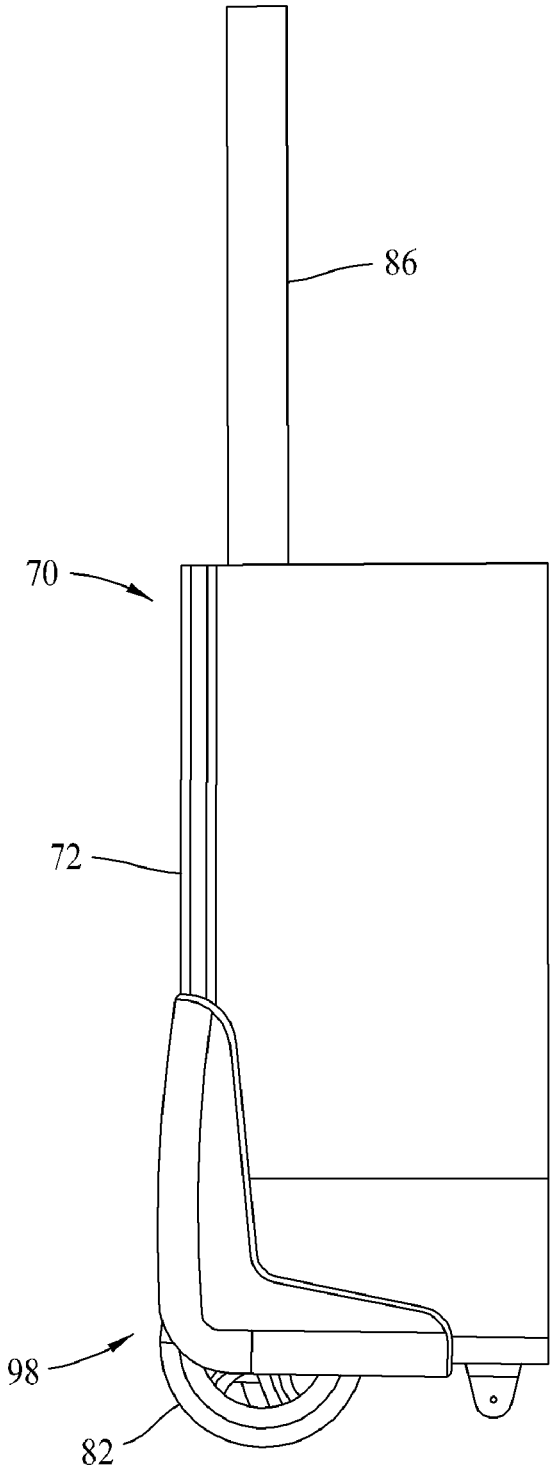
FIG. 5 is a side elevational view of a portion of the towable baggage item including an exemplary retractable wheel assembly in an extended position.

FIG. 5 is a side elevational view of a portion of the towable baggage item 70 including an exemplary retractable wheel assembly 98 in an extended position. When in the extended position, the wheels 82 of retractable wheel assembly 98 extend from body 72 and the support poles 86 also extended from body 72.

Figure 6:
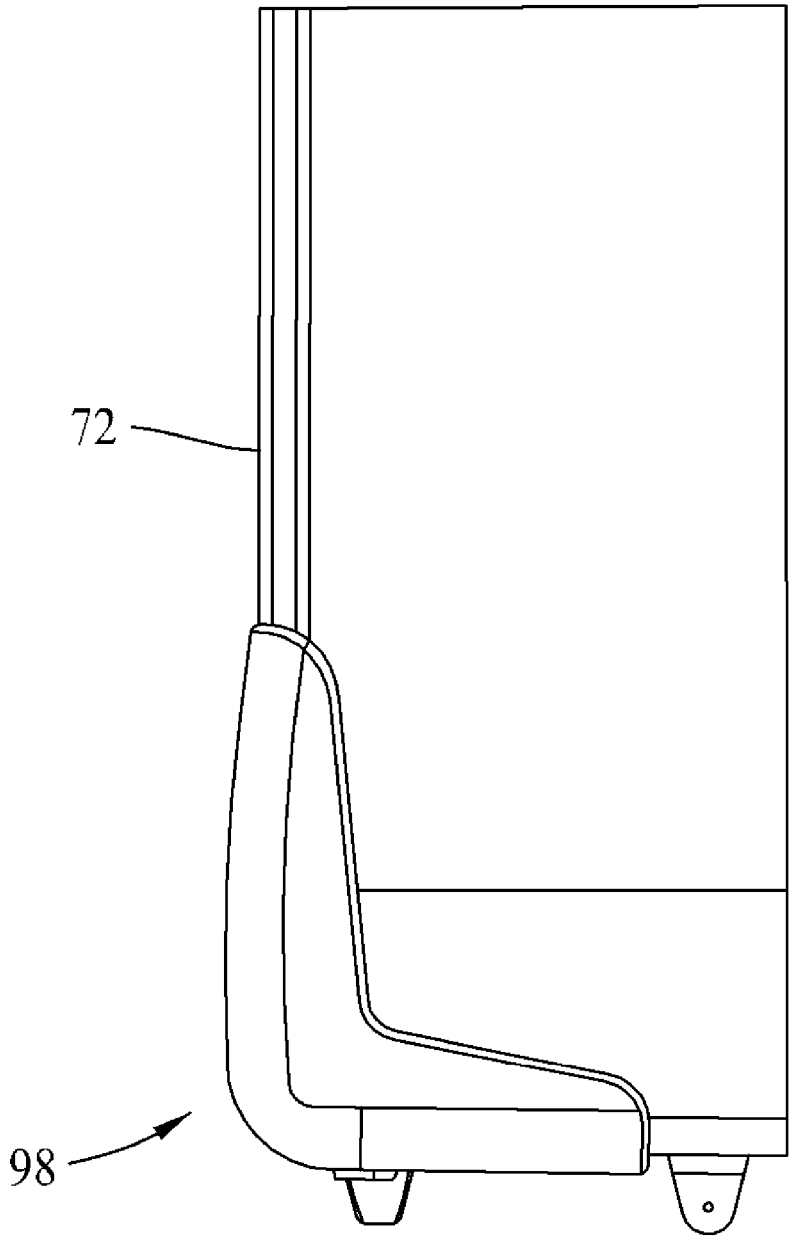
FIG. 6 is a view similar to FIG. 5 but illustrating the retractable wheel assembly in a retracted position.

FIG. 6 is a view similar to FIG. 5 but illustrating the retractable wheel assembly 98 in a retracted position. When in the retracted position, the wheels 82 (not shown in FIG. 6) of retractable wheel assembly 98 retract into body 72 and the support poles 86 (not shown in FIG. 6) also retract into body 72.

Figure 7:
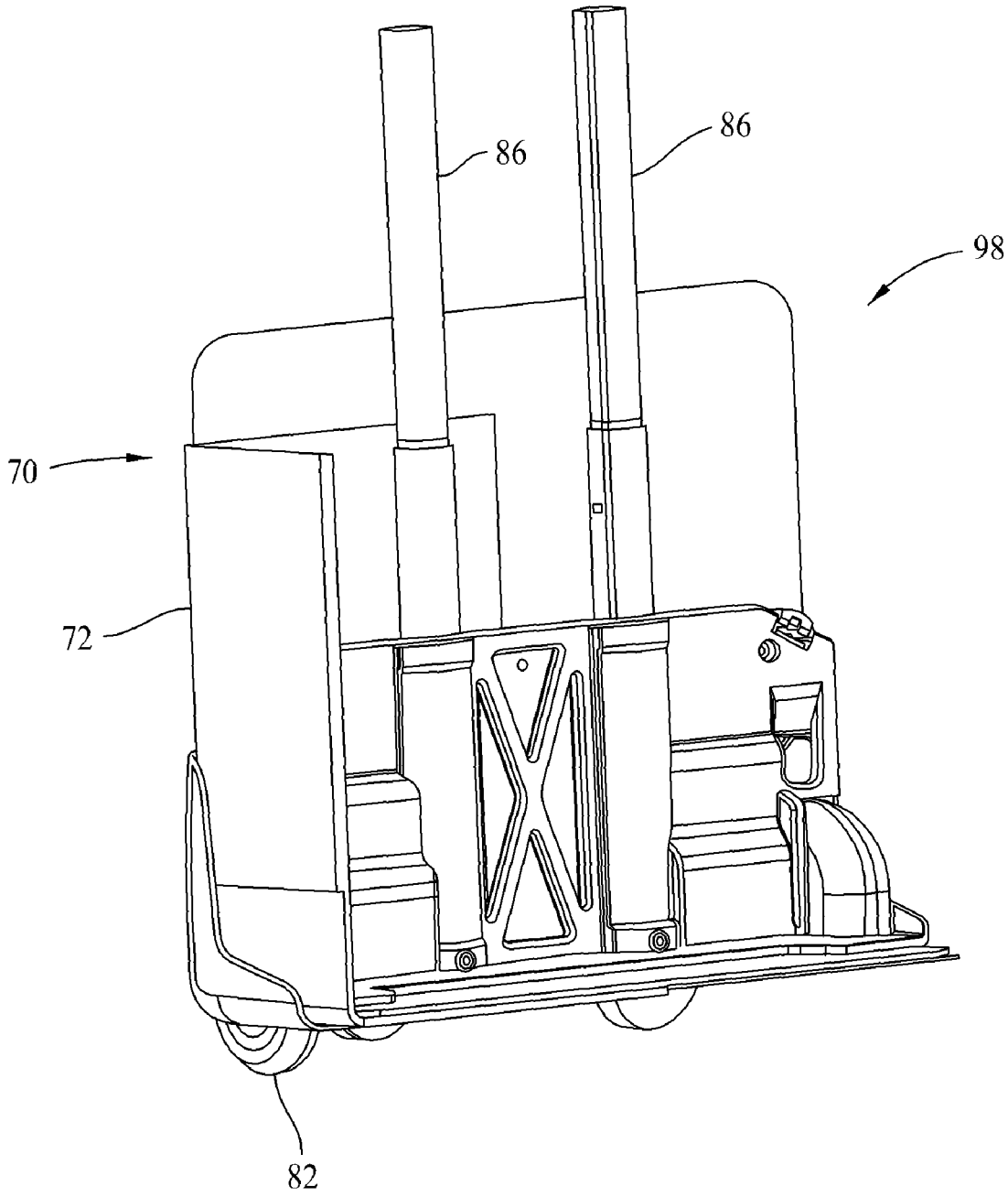
FIG. 7 is a partial perspective view of the retractable wheel assembly shown in FIG. 5 in the extended position.

FIG. 7 is a partial perspective view of the retractable wheel assembly 98 shown in FIG. 5 in the extended position. As described in regard to FIG. 5, when in the extended position, the wheels 82 of retractable wheel assembly 98 extend from body 72 and the support poles 86 also extended from body 72.

Figure 8:
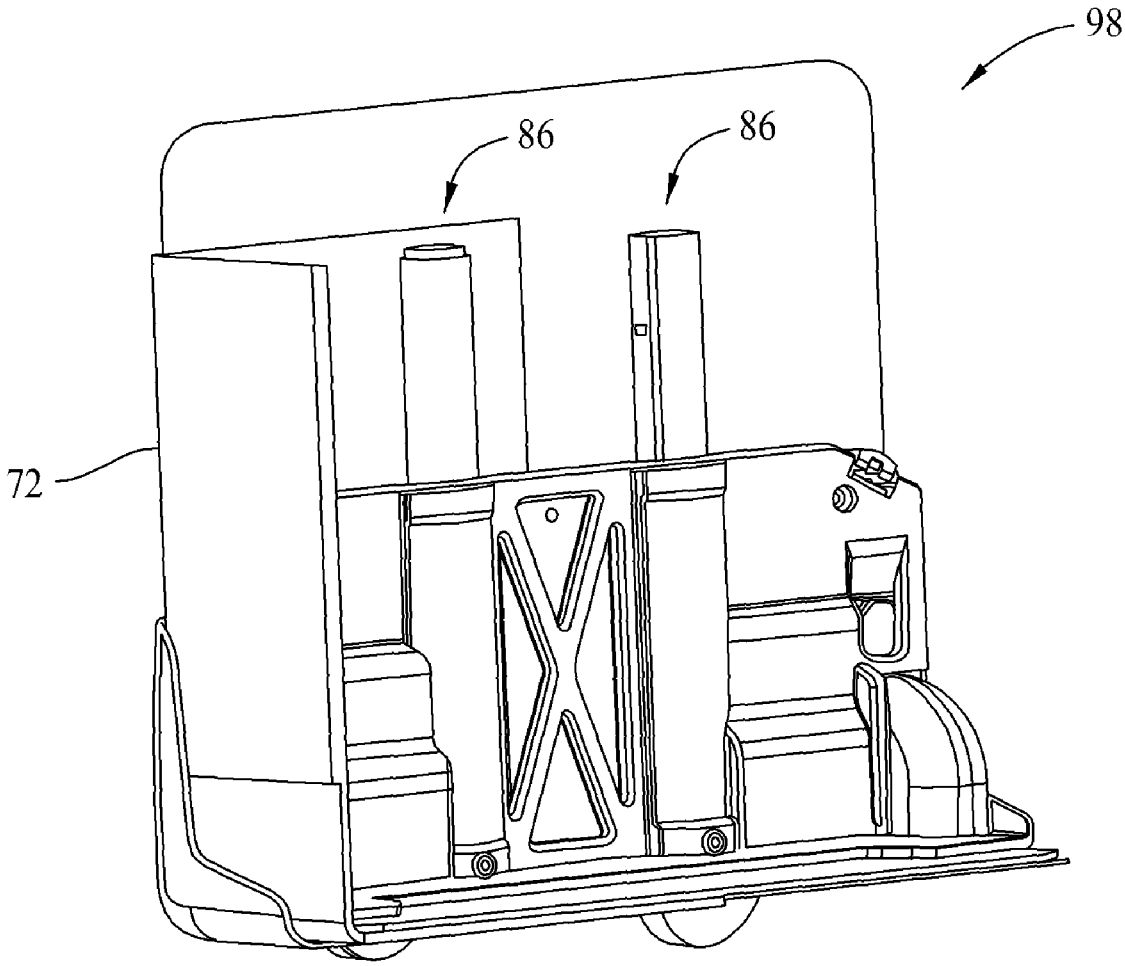
FIG. 8 is a partial perspective view of the retractable wheel assembly shown in FIG. 5 in the retracted position.

FIG. 8 is a partial perspective view of the retractable wheel assembly 98 shown in FIG. 6 in the retracted position. As described in regard to FIG. 6, when in the retracted position, the wheels 82 (not shown in FIG. 8) of retractable wheel assembly 98 retract into body 72 and the support poles 86 also retract into body 72.

Figure 9:
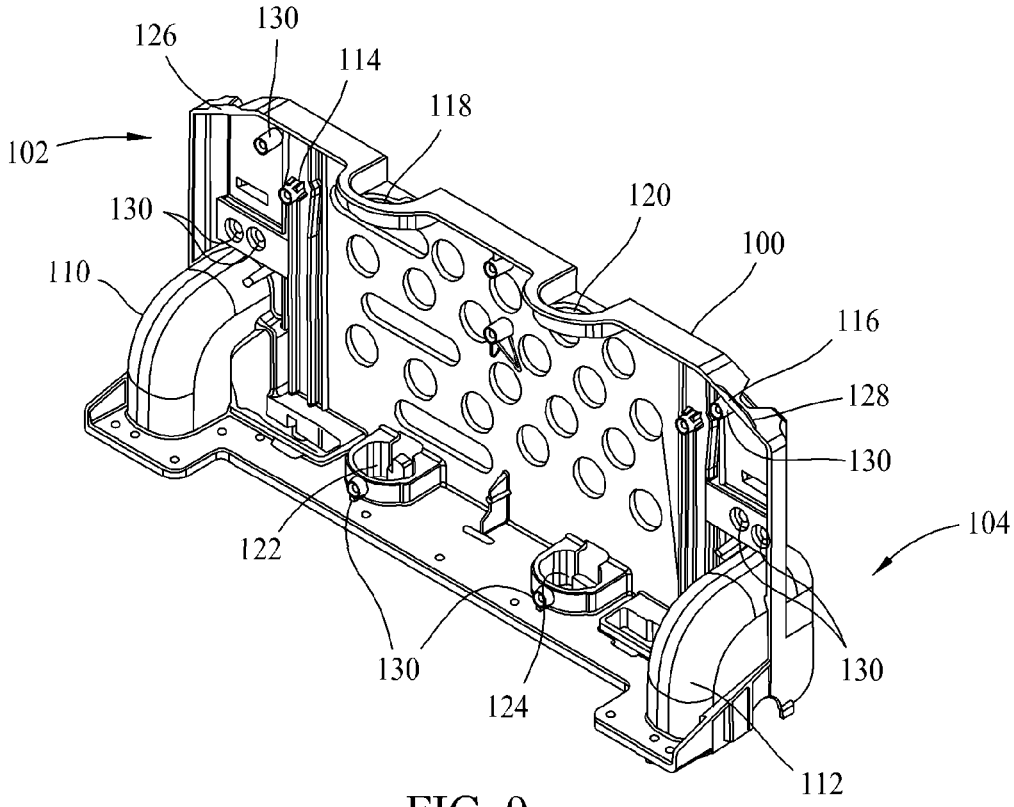
FIG. 9 is a front perspective view of an exemplary bottom frame for the retractable wheel assembly shown in FIGS. 7 and 8.

FIG. 9 is a front perspective view of an exemplary bottom frame 100 for the retractable wheel assembly 98 shown in FIGS. 7 and 8. The exemplary bottom frame 100 having a first end 102 and a second end 104. The bottom frame 100 includes a first wheel well 110, a second wheel well 112, a first actuator guide post 114, a second actuator guide post 116, a first support pole opening 118, a second support pole opening 120, a first support pole rest 122, a second support pole rest 124, a first cover slot 126, a second cover slot 128, and a plurality of fastener openings 130.

Figure 10:
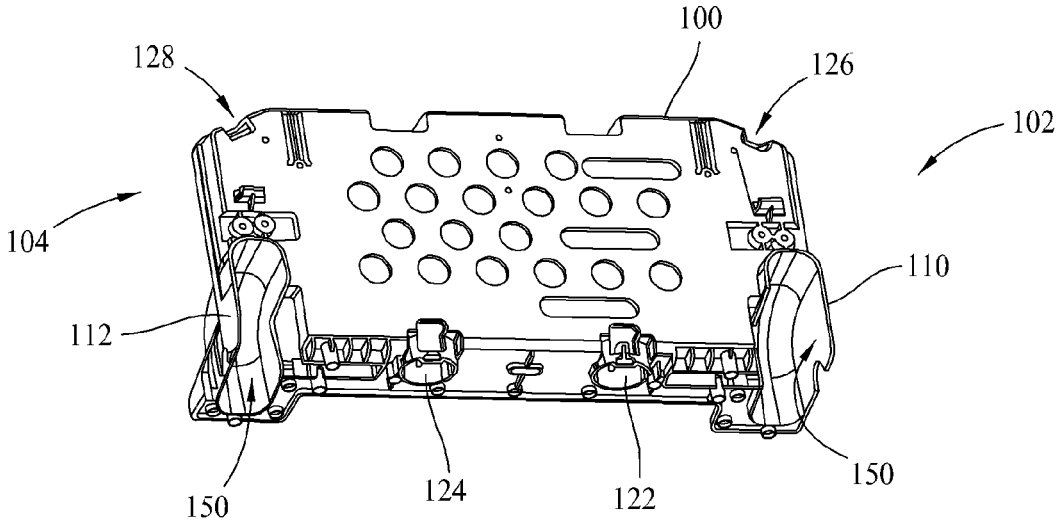
FIG. 10 is a rear perspective view of the bottom frame shown in FIG. 9.

FIG. 10 is a rear perspective view of the bottom frame 100 shown in FIG. 9. An interior portion 150 of first and second wheel wells 110, 112 is shown. The wheel wells 110, 112 are configured to accept the wheels 82 when the wheels 82 are retracted by the wheel assembly 98. The interior portion 150 of wheel wells 110, 112 may be slightly larger that the wheels 82. More specifically, in a retracted position, a tolerance may be provided between the wheels 82 and the interior portion 150 of wheel wells 110, 112 to ensure that contact between the wheels 82 and the wheel wells 110, 112 does not prevent the wheels 82 from retracting. However, it is also advantageous for the wheel wells 110, 112 to be no larger than necessary so that a minimum amount of the interior of the baggage item 70 is occupied by the wheel wells 110, 112.

Figure 11:
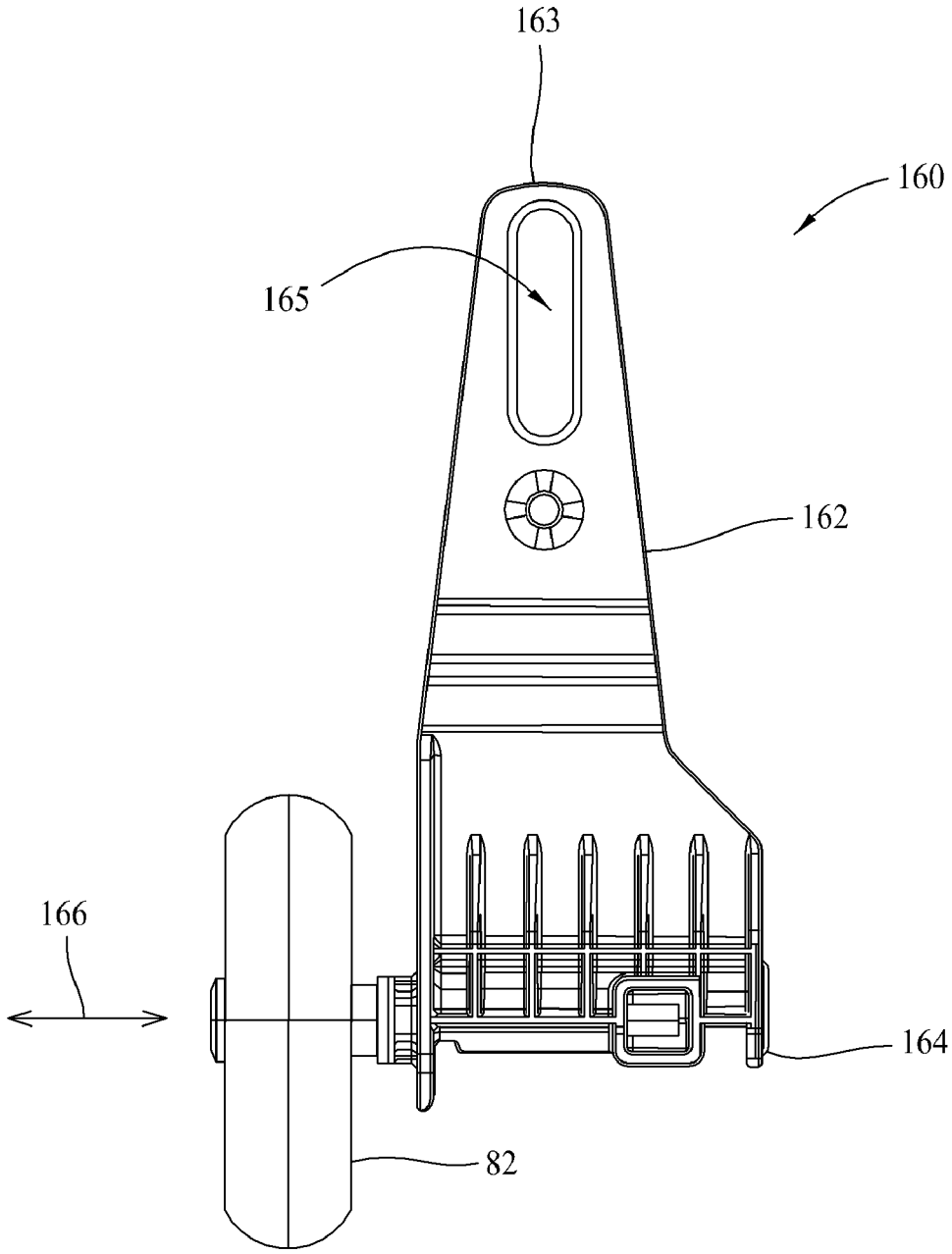
FIG. 11 is a front elevational view of an exemplary wheel carrier for the retractable wheel assembly shown in FIGS. 7 and 8.

FIG. 11 is a front elevational view of an exemplary wheel carrier 160 for the retractable wheel assembly 98 shown in FIGS. 7 and 8. The first wheel carrier 160 includes a wheel carrier body 162 having an upper end 163 and a lower end 164. The first wheel carrier 160 also includes a wheel carrier slot 165 positioned near the upper end 163. The first wheel carrier 160 is coupled to wheel 82, such that wheel 82 can rotate about an axis 166.

Figure 12:
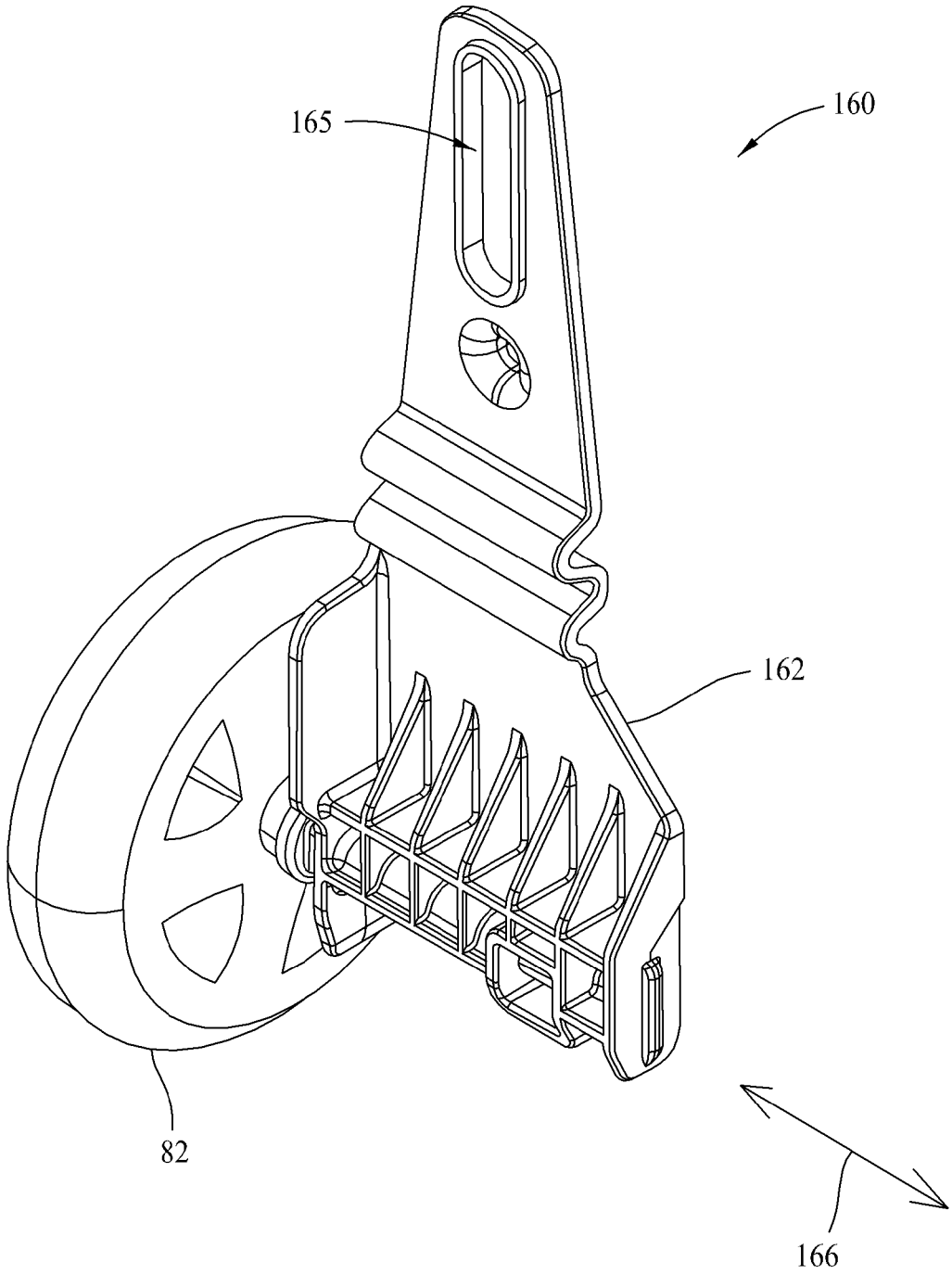
FIG. 12 is a perspective view of the wheel assembly shown in FIG. 11.

FIG. 12 is a perspective view of the wheel carrier 160 shown in FIG. 11. Like features are labeled with like reference numerals.

Figure 13:
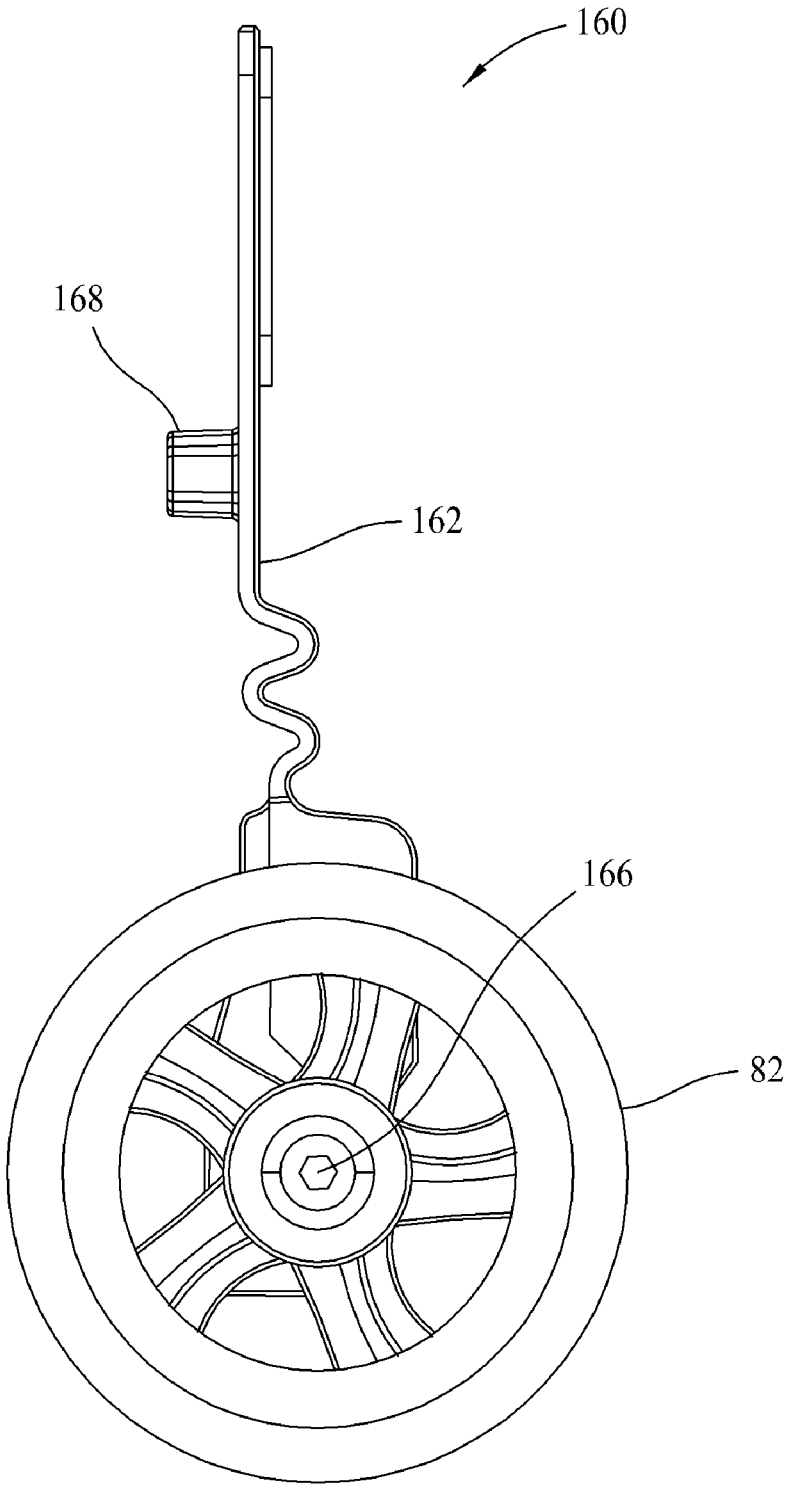
FIG. 13 is a side elevational view of the wheel assembly shown in FIG. 11.

FIG. 13 is a side elevational view of the wheel carrier 160 shown in FIGS. 11 and 12. The side view of FIG. 13 shows a first wheel carrier post 168 extending from a rear of wheel carrier body 162. The axis 166 around which wheel 82 rotates extends into and out of FIG. 13.

Figure 14:
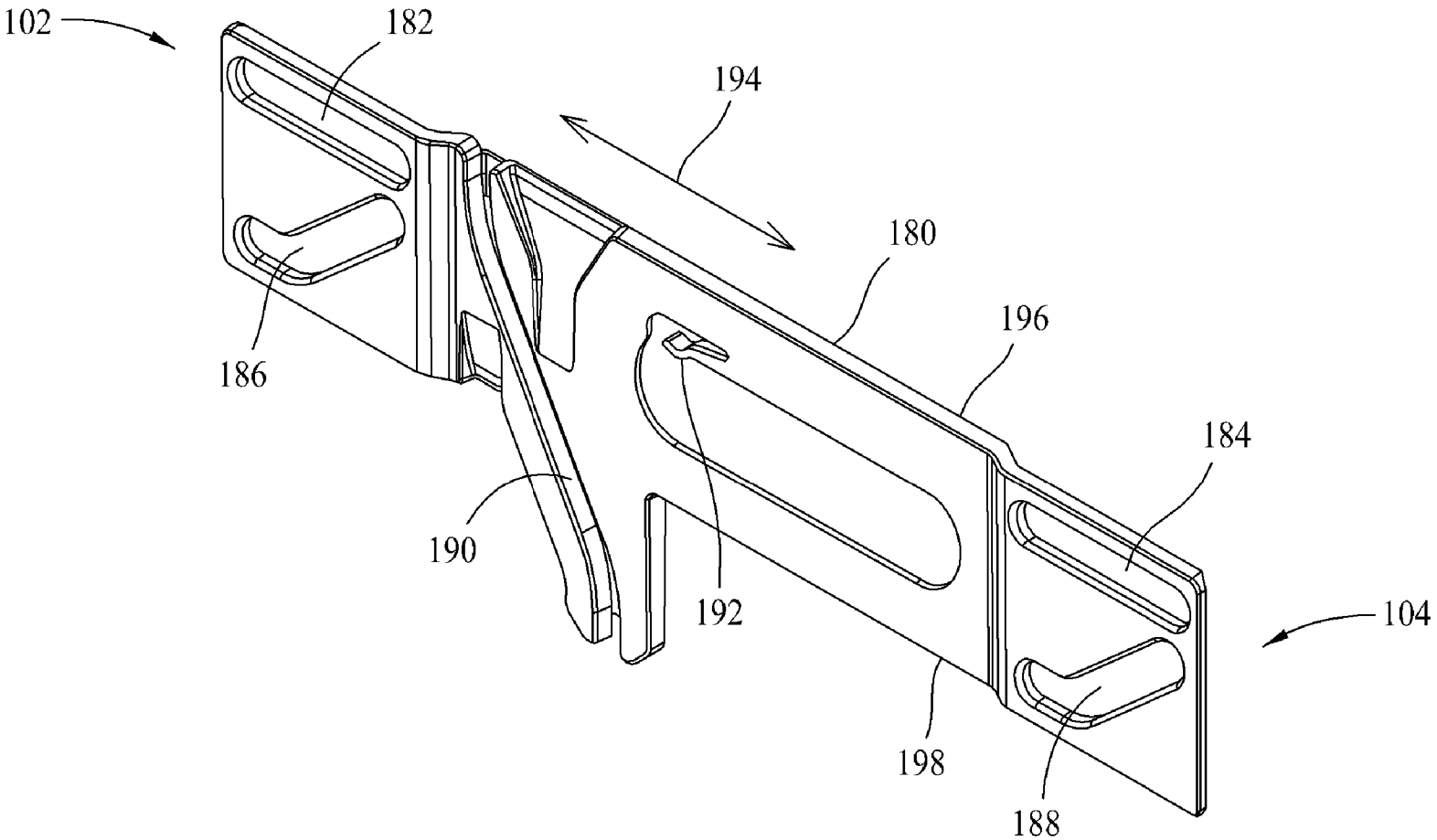
FIG. 14 is a perspective view of an exemplary wheel assembly actuator for the retractable wheel assembly shown in FIGS. 7 and 8.

FIG. 14 is a perspective view of an exemplary wheel assembly actuator 180 for the retractable wheel assembly 98 shown in FIGS. 7 and 8. The exemplary wheel assembly actuator 180 includes a first bottom frame actuation slot 182, a second bottom frame actuation slot 184, a first wheel carrier actuation slot 186, a second wheel carrier actuation slot 188, a support pole channel 190, and an actuator lock 192. For reference, a first axis 194 is illustrated. First axis 194 extends between the first end 102 and the second end 104 of actuator 180 and is parallel to the rotational axis 166 of the wheel 82.

The first and second bottom frame actuation slots 182, 184 extend through actuator 180 and along the first axis 194. Furthermore, the first and second bottom frame actuation slots 182, 184 are configured to receive actuator guide posts 114, 116, respectively, of bottom frame 100.

The first and second wheel carrier actuation slots 186, 188 also extend through actuator 180, however, actuation slots 186, 188 extend obliquely to the first axis 194 and the first and second bottom frame actuation slots 182, 184. Each of the first and second wheel carrier actuation slots 186, 188 are configured to receive one wheel carrier post 168 of wheel carrier 160 (see FIG. 13).

Wheel assembly actuator 180 further includes a nonlinear support pole channel 190. Support pole channel 190 is positioned within wheel assembly actuator, extending from an upper portion 196 of actuator 180, to a lower portion 198 of actuator 180. Support pole channel 190 is configured to receive a tab of a telescoping pole (not shown in FIG. 14) and extends obliquely to first axis 194.

Slots 182, 184, 186, and 188 are described as extending through actuator 180. Channel 190 is shown having portions that extend through actuator 180, but not extending through actuator 180 in the entirety. Slots 182, 184, 186, and 188 may also be channels so long as the corresponding post can be received and slide within the slot/channel.

Wheel assembly actuator 180 also includes the actuator lock 192. The actuator lock 192 is configured to lock actuator 180 in a position closer to first end 102 or to second end 104 of bottom frame 100. A convex edge of actuator lock 192 faces toward a lower portion of actuator 180.

Figure 15:
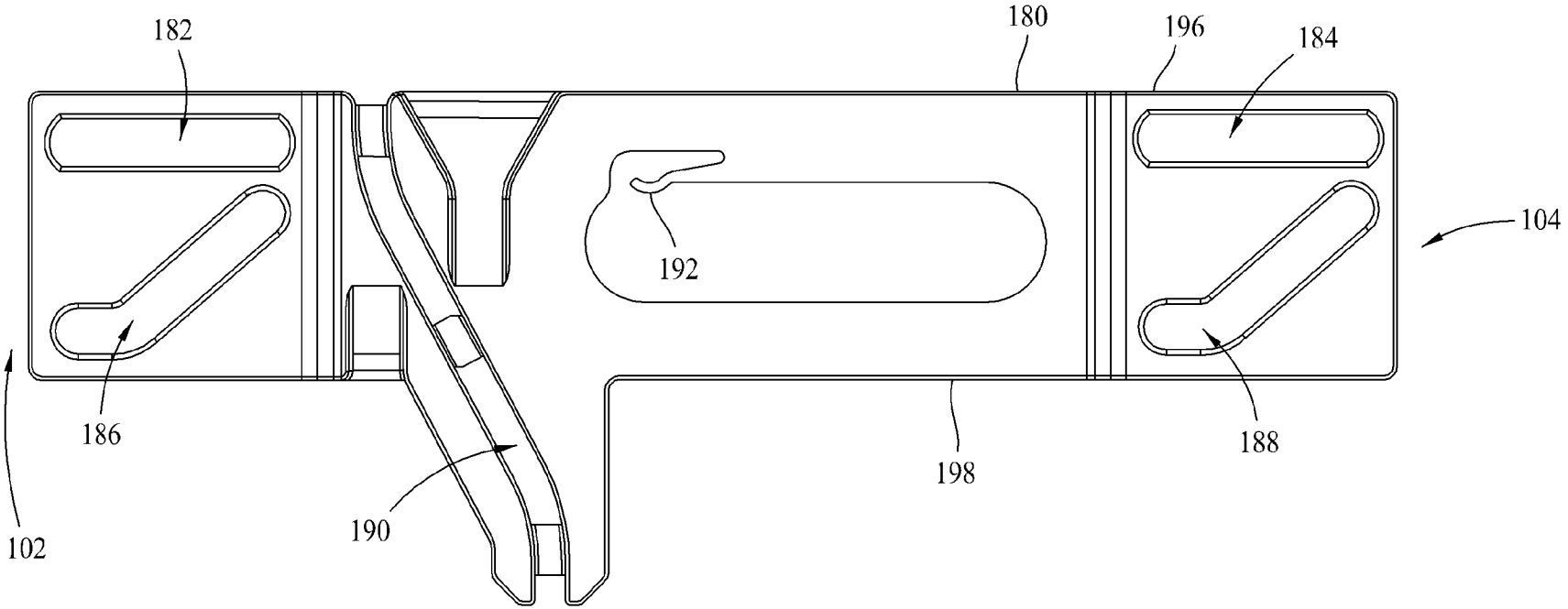
FIG. 15 is a front elevational view of the wheel assembly actuator shown in FIG. 14.

FIG. 15 is a front elevation view of the wheel assembly actuator 180 shown in FIG. 14. Like features are labeled with like reference numerals.

Figure 16:
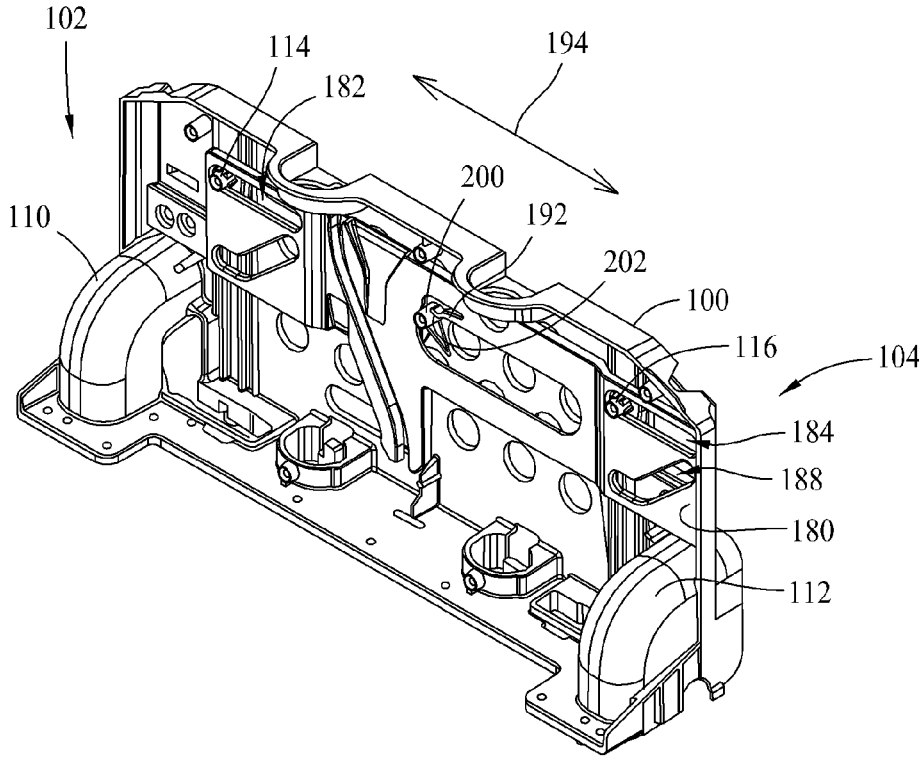
FIG. 16 is a first assembly view of the wheel assembly actuator slidably coupled to the bottom frame.

FIG. 16 is a first assembly view of the wheel assembly actuator 180 of FIGS. 14 and 15 slidably coupled to the bottom frame 100 of FIG. 9. Actuator 180 is slidably coupled to the bottom frame 100 when actuator guide posts 114, 116 are placed through bottom frame actuation slots 182, 184, respectively. Actuator 180 spans substantially an entire distance between the first wheel well 110 and the second wheel well 112.

Actuator lock post 200 is positioned adjacent to the actuator lock 192. Actuator lock 192 includes a curved edge, including a center portion 202, which presses against actuator lock post 200. As the actuator 180 is slid along first axis 194 between the first end 102 and the second end 104 of bottom frame 100, actuator lock 192 holds actuator 180 in position.

Figure 17:
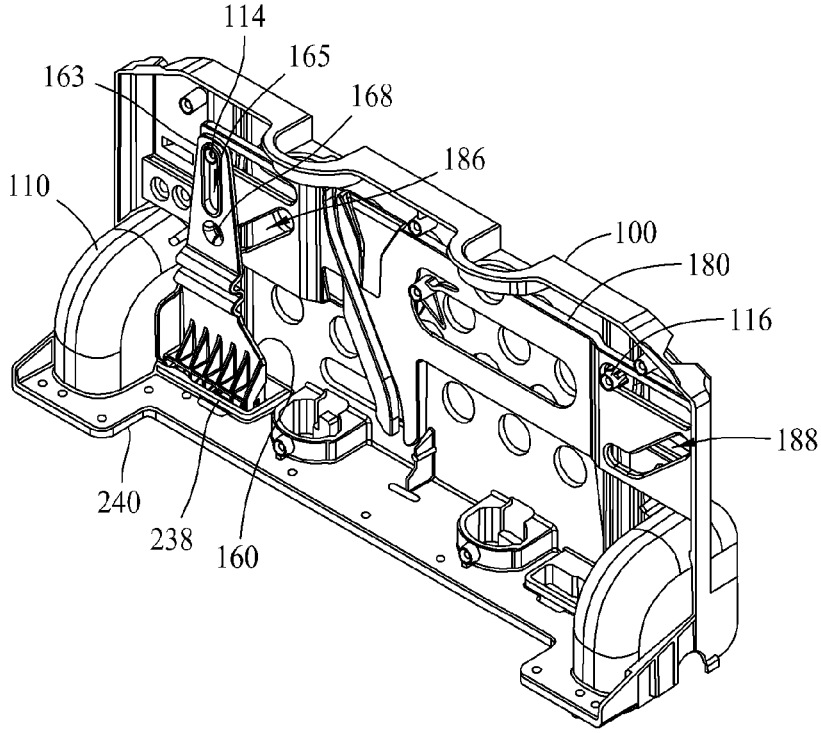
FIG. 17 is a second assembly view of a wheel carrier slidably coupled to the wheel assembly actuator and the bottom frame.

FIG. 17 is a second assembly view of a wheel carrier 160 slidably coupled to the wheel assembly actuator 180 and the bottom frame 100. First actuator guide post 114 is placed through wheel carrier slot 165 and wheel carrier post 168 is placed through first wheel carrier actuation slot 186. FIG. 17 illustrates first wheel carrier 160 slidably coupled to actuator 180 and bottom frame 100. Although not shown, a second wheel carrier may also be slidably attached to actuator 180 and bottom frame 100. In an exemplary embodiment, the second wheel carrier is similar to first wheel carrier 160, but reversed such that a wheel carrier slot within the second wheel carrier aligns with actuator guide post 116, and a wheel carrier post that extends from the second wheel carrier aligns with second wheel carrier actuation slot 188.

In order to position the first actuator guide post 114 through wheel carrier slot 165, the upper end 163 of wheel carrier 160 is placed through a guide slot 238 in a lower portion 240 of bottom frame 100. Although not shown in FIG. 17, once wheel carrier 160 is positioned as described above, wheel 82 is positioned within wheel well 110.

Figure 18:
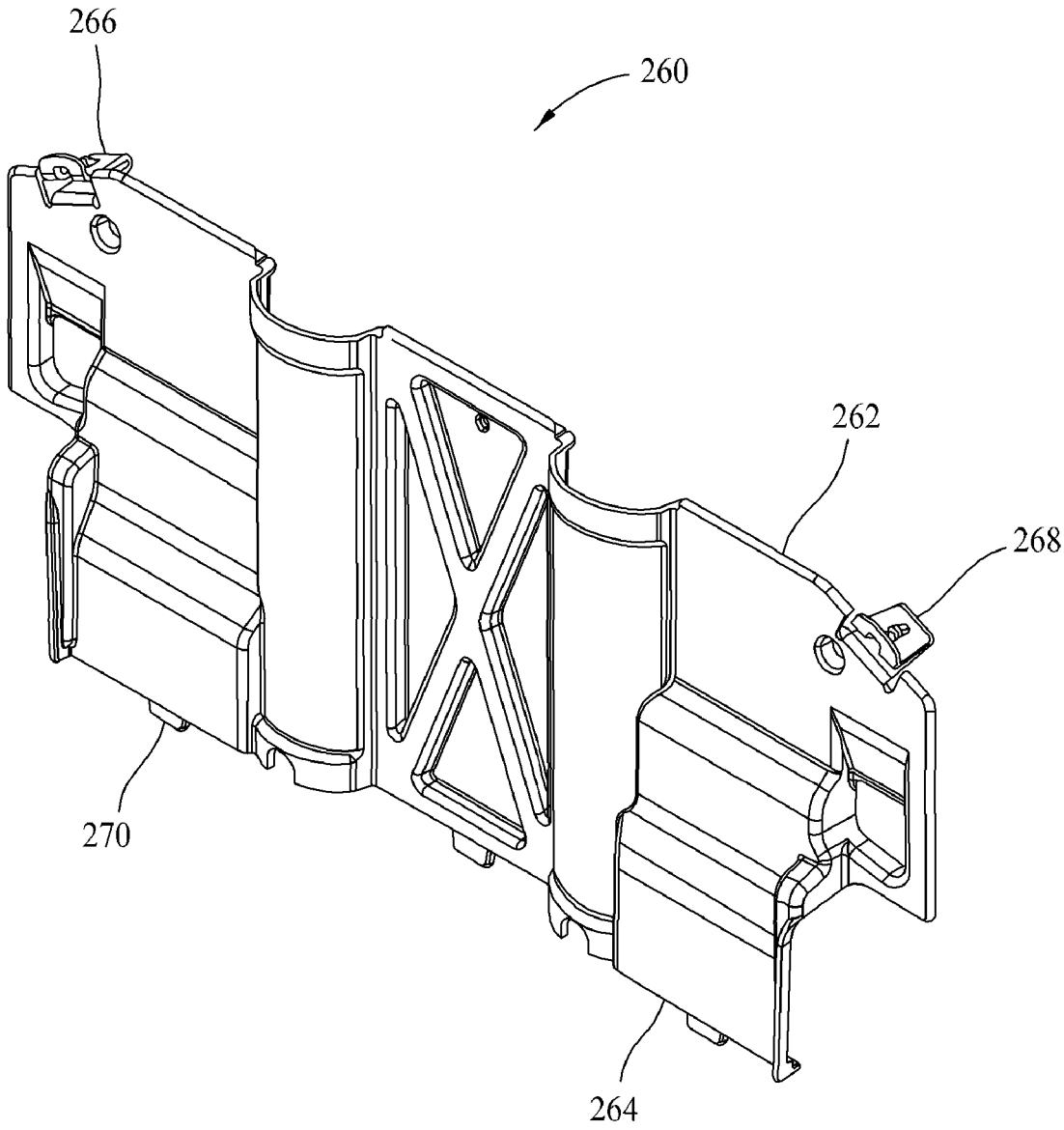
FIG. 18 is a perspective view of an exemplary cover for the wheel assembly shown in FIGS. 7 and 8.

FIG. 18 is a perspective view of an exemplary cover 260 for the wheel assembly shown in FIGS. 7 and 8. Cover 260 includes an upper edge 262 and a lower edge 264. Cover 260 also includes cover tabs 266, 268, which are configured to couple with cover slots 126, 128 (see FIG. 9). Cover 260 also includes at least one tab 270 along lower edge 264. The at least one tab 270 is configured to fit within a slot positioned within bottom frame 100 and in combination with tabs 266, 268 and slots 126, 128, configured to secure cover 260 to bottom frame 100.

Figure 19:
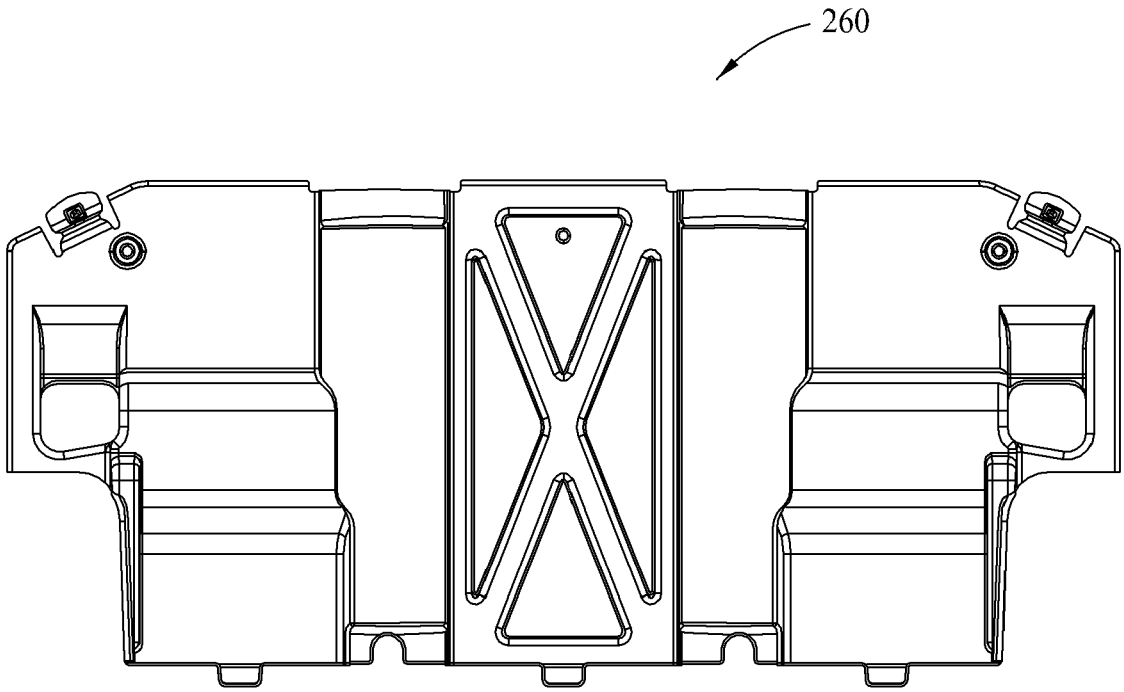
FIG. 19 is a front elevational view of the cover shown in FIG. 18.

FIG. 19 is a front elevational view of the cover 260 shown in FIG. 18. Like features are labeled with like reference numerals. Cover 260 is configured to protect components such as the actuator 180 and the wheel carrier 160, and to also maintain the position of components such as the actuator 180, wheel carrier 160, and towing handle system 84. Cover 260 includes openings that, in combination with fastener openings 130 of bottom frame 100 and a plurality of fasteners, may be used to attach cover 260 and bottom frame 100 to the baggage item 70.

Figure 20:
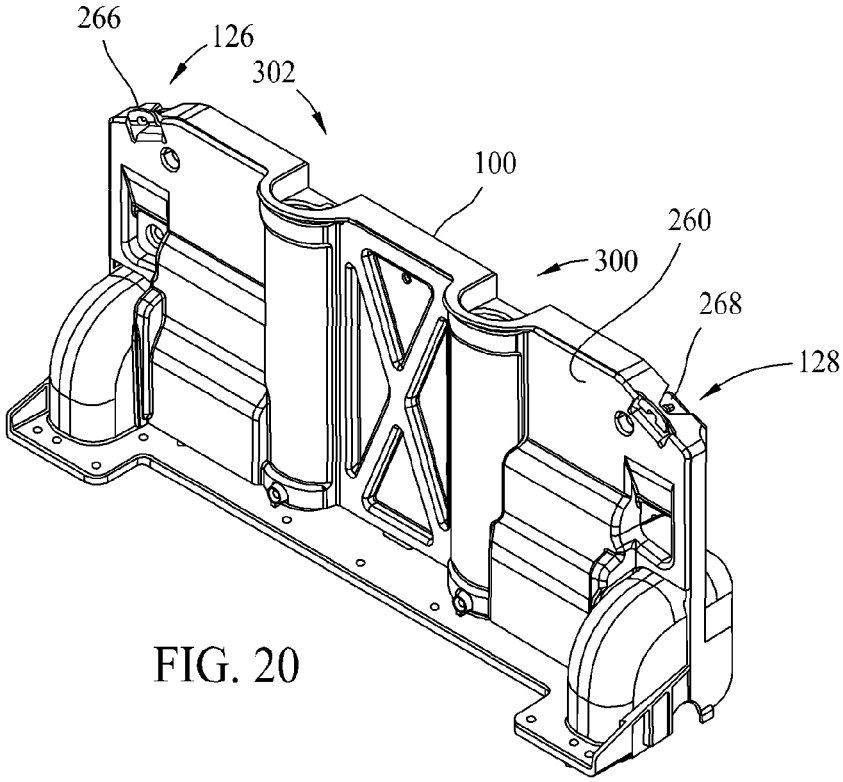
FIG. 20 is an assembly view illustrating the cover attached to the assembly shown in FIG. 17.

FIG. 20 is an assembly view illustrating the cover 260 attached to the assembly shown in FIG. 17. The at least one tab 270 along lower edge 264 of cover 260 is positioned within a slot within bottom frame 100. Cover tabs 266, 268 are aligned with cover slots 126, 128. Once the at least one tab 270 is positioned within at least one corresponding slot, and the cover tabs 266, 268 are positioned within cover slots 126, 128, cover 260 is securely attached to bottom frame 100. Two support pole openings 300, 302 are formed between cover 260 and bottom frame 100.

Figure 21:
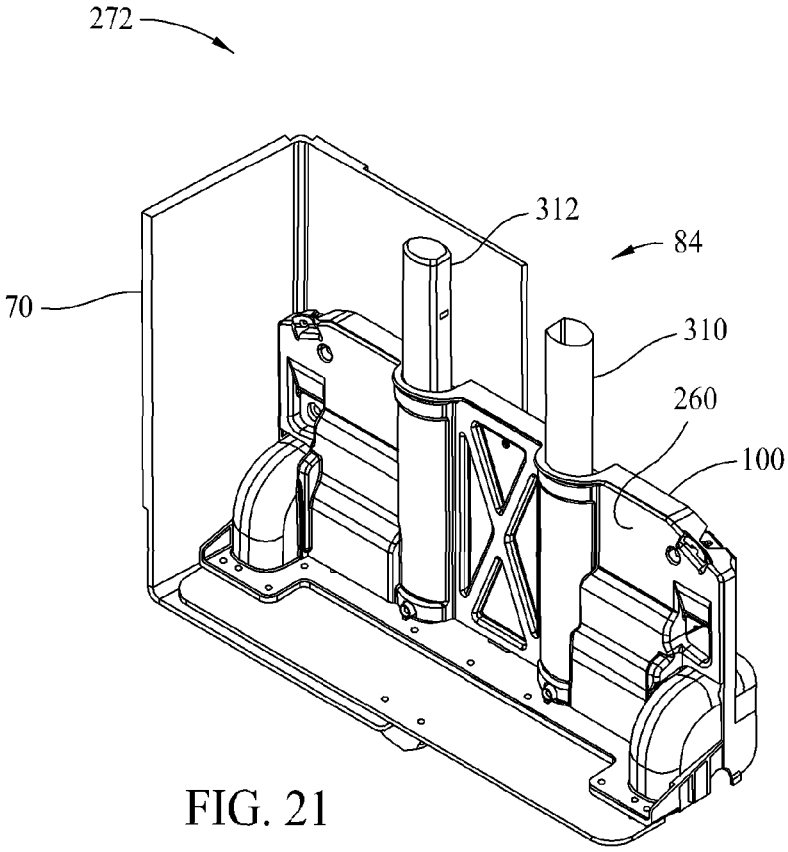
FIG. 21 is a perspective view of a retractable wheel assembly, partially shown in FIG. 20, coupled to a baggage item.

FIG. 21 is a perspective view of a retractable wheel assembly 272, partially shown in FIG. 20, coupled to the baggage item 70. The retractable wheel assembly 272 includes the bottom frame 100, the actuator 180 (not shown in FIG. 21), at least one wheel carrier 160 (also not shown in FIG. 21), the towing handle system 84, and the cover 260. As described above, towing handle system 84 may include support pole assemblies 310, 312 and the carrying handle 80 (not shown in FIG. 21). The assembly 272 may be coupled to the baggage item 70 in a variety of ways including, but not limited to, rivets, bolts, adhesives, and stitching.

Figure 22:
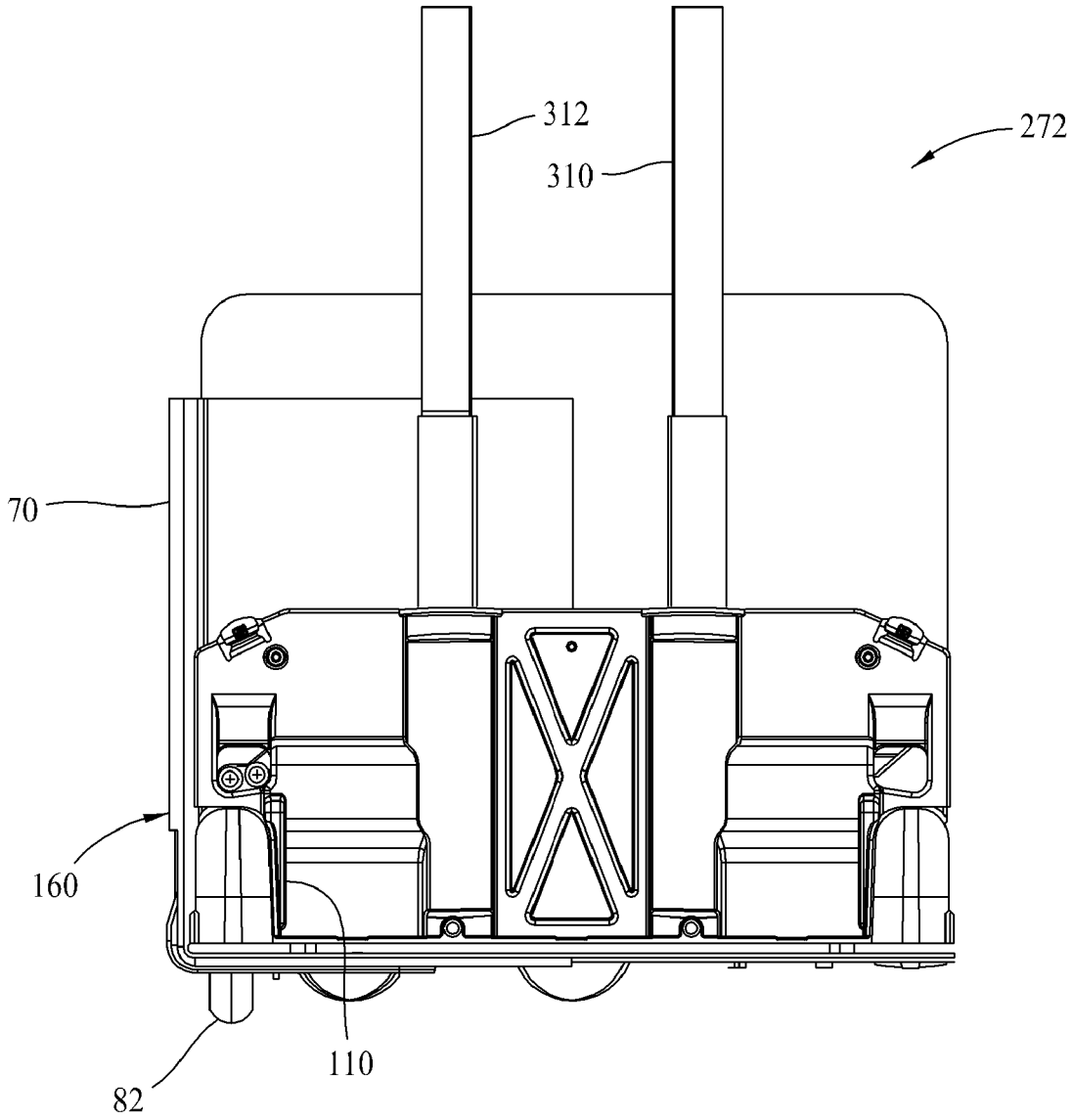
FIG. 22 is a front elevational view of the retractable wheel assembly of FIG. 21 with the wheel carrier in an extended position.

FIG. 22 is a front elevational view of the retractable wheel assembly 272 of FIG. 21 with the wheel carrier 160 in an extended position. Wheel 82 extends from wheel well 110 such that the baggage item 70 can be towed by a user.

Figure 23:
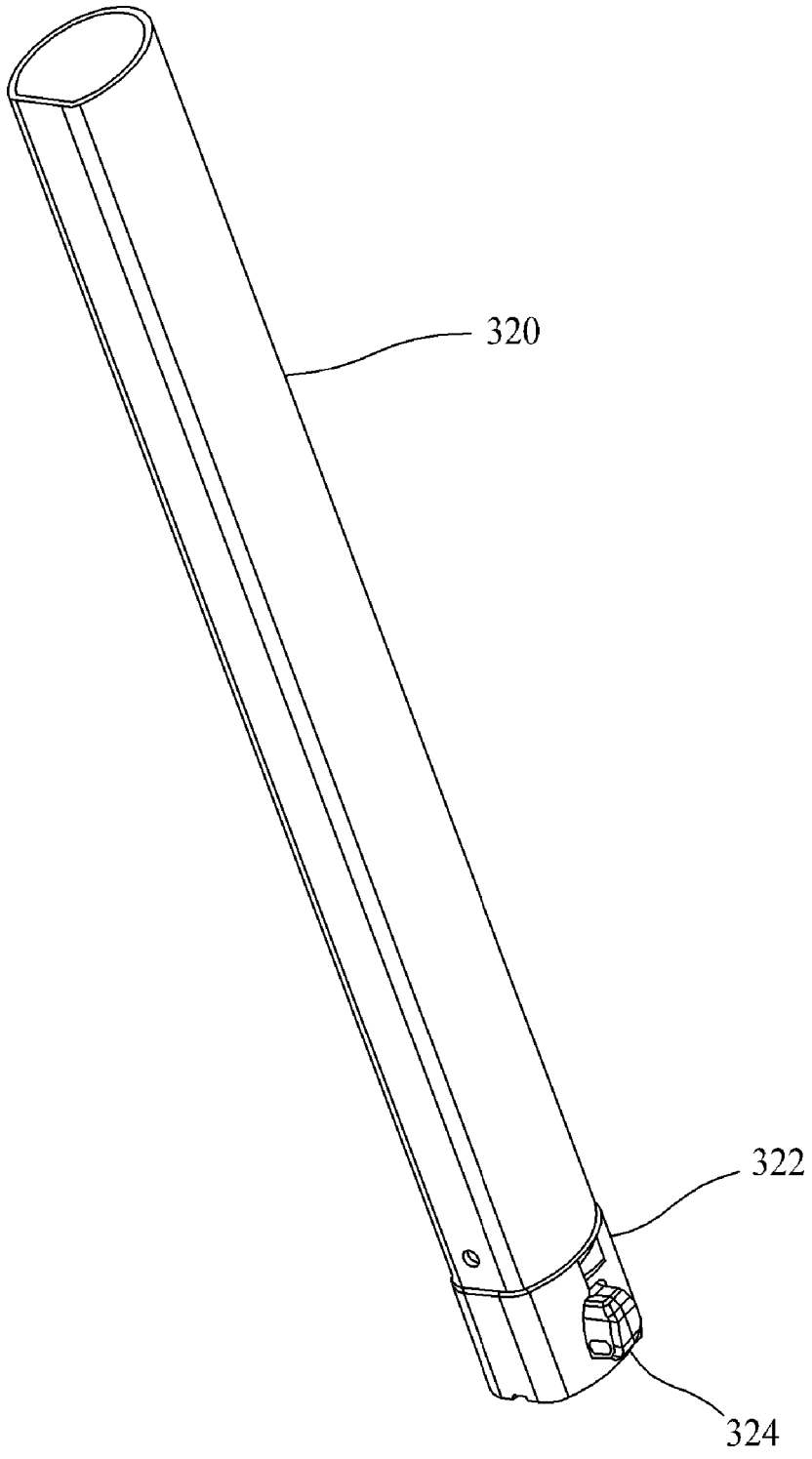
FIG. 23 illustrates a portion of an exemplary support pole assembly.

FIG. 23 illustrates an inner portion 320 of an exemplary support pole assembly 312 (see FIG. 22). The inner portion 320 includes an end portion 322 that includes an actuator tab 324 that extends from the end portion 322. The actuator tab 324 is configured to be received by the support pole channel 190 (see FIG. 14).

Figure 24:
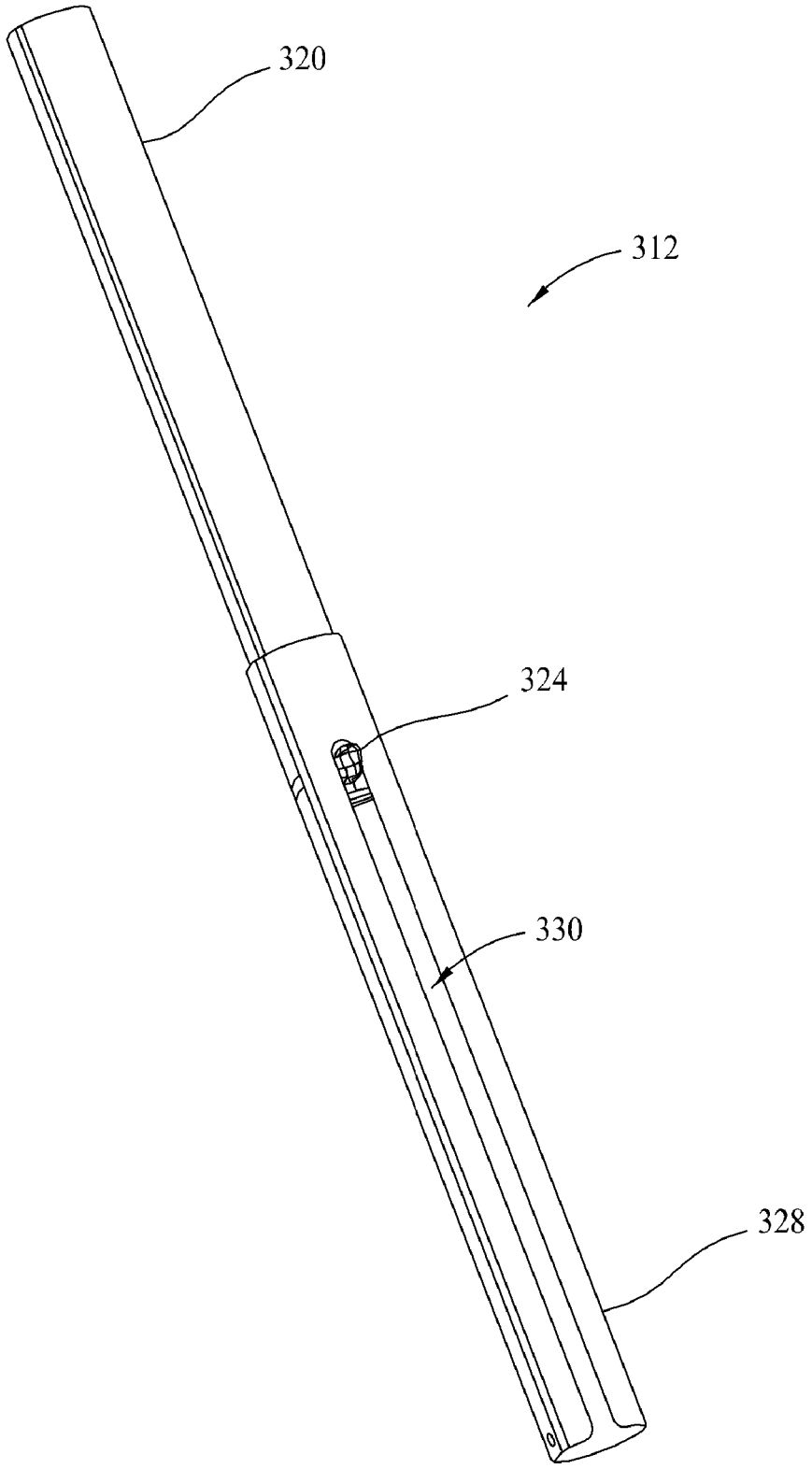
FIG. 24 illustrates an exemplary support pole in the extended position.

FIG. 24 illustrates an exemplary support pole assembly 312 in the extended position. In the embodiment of FIG. 24, the support pole assembly 312 includes inner portion 320 of FIG. 23 and an outer portion 328. Inner portion 320 is configured to slide within outer portion 328 in a telescoping manner. Outer portion 328 includes an actuator tab channel 330, configured such that actuator tab 324 fits within actuator tab channel 330.

Figure 25:
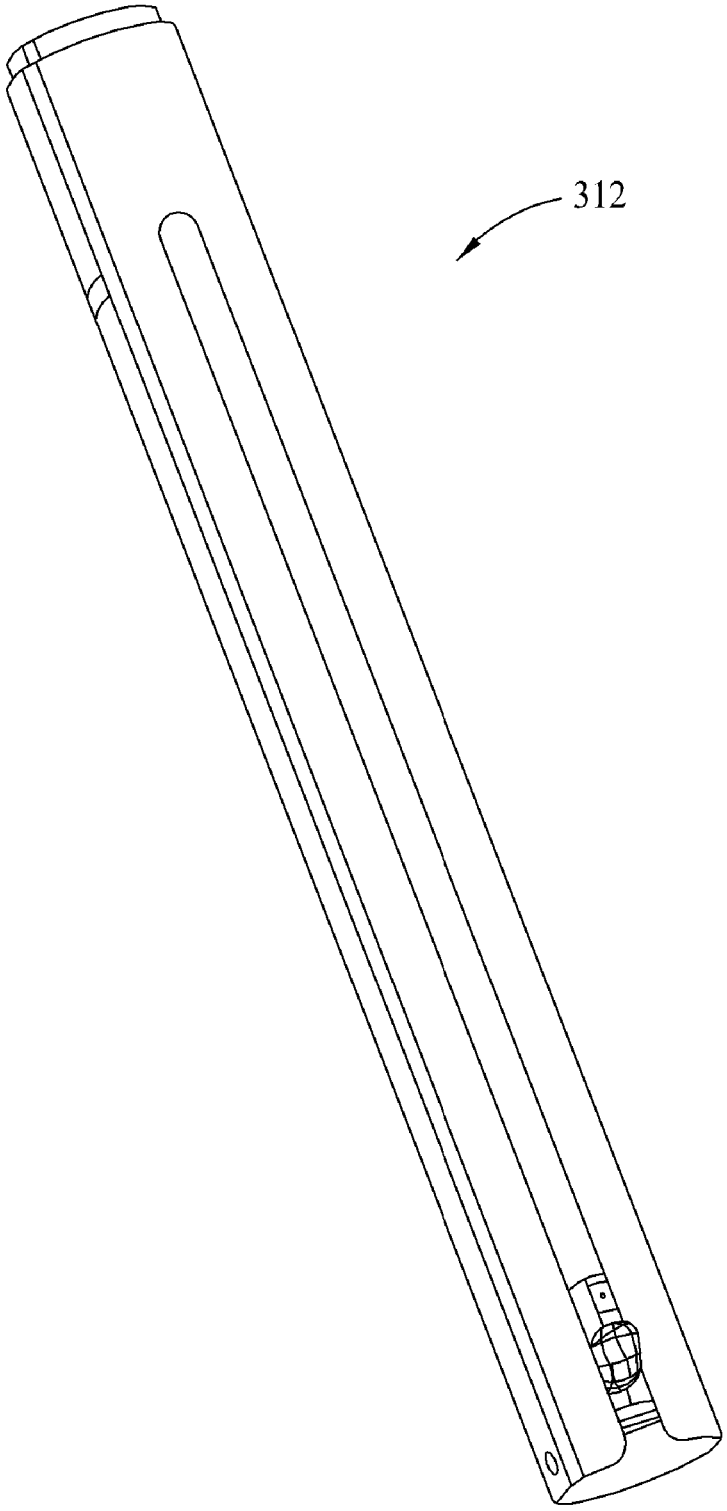
FIG. 25 illustrates the exemplary support pole shown in FIG. 23 in a retracted position.

FIG. 25 illustrates the exemplary support pole assembly 312 shown in FIG. 23 in a retracted position. The telescoping relationship between inner portion 320 and outer portion 328 of support pole assembly 312 allows the towing handle system 84 to be of a length that facilitates towing of the baggage item 70 when in an extended state, but also facilitates storage of the baggage item 70 when in a retracted state.

Figure 26:
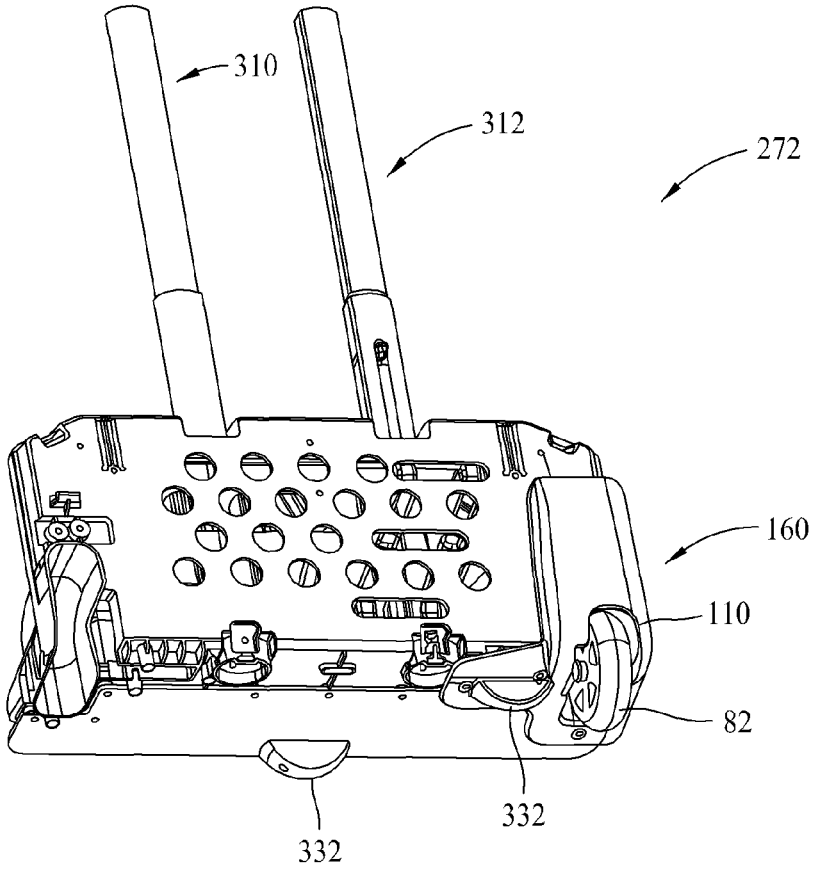
FIG. 26 is a rear perspective view of the retractable wheel assembly of FIG. 21, including a wheel carrier in an extended position.

FIG. 26 is a rear perspective view of the retractable wheel assembly 272 of FIG. 21. FIG. 26 shows the retractable wheel assembly 272 with the wheel carrier 160 in an extended position. Support pole assemblies 310, 312 are pulled into an extended position, causing wheel 82 to extend from wheel well 110 to allow a user to tow the baggage item. FIG. 26 also shows a plurality of feet 332 extending from a bottom of the retractable wheel assembly 272. When wheel assembly 272 is in a retracted position, the bottom feet 332 protect the bottom wall of the baggage item. In one example, by raising the bottom wall of the baggage item off of the ground, the baggage item, and the contents held within, do not get wet even though the ground is wet.

When the wheel assembly 272 is in an extended position, wheel 82 extends out from the bottom of the baggage item body 72 further than an adjacent foot 332, enabling the wheel 82 to roll along a surface and a user to tow the baggage item.

Figure 27:
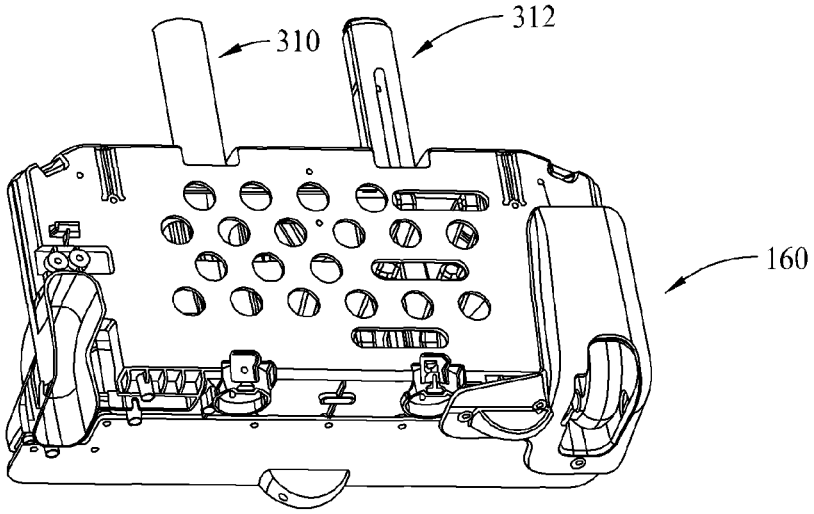
FIG. 27 is a rear perspective view of the retractable wheel assembly of FIG. 21, including a wheel carrier in a retracted position.

FIG. 27 is a rear perspective view of the retractable wheel assembly 272 shown in FIG. 21. FIG. 27 shows the retractable wheel assembly 272 with the wheel carrier 160 in a retracted position. Support pole assemblies 310, 312 are pushed into a retracted position, causing wheel 82 to retract within wheel well 110.

FIGS. 28-32 illustrate the interaction between the moving parts within the retractable wheel assembly 272. The moving parts within the retractable wheel assembly 272 are the actuator 180, the support pole 312, and the wheel carrier 160. As stated above, a second wheel carrier may be included, but is not described in conjunction with FIG. 28. However, the second wheel carrier would operate in the same manner as the first wheel carrier 160.

Figure 28:
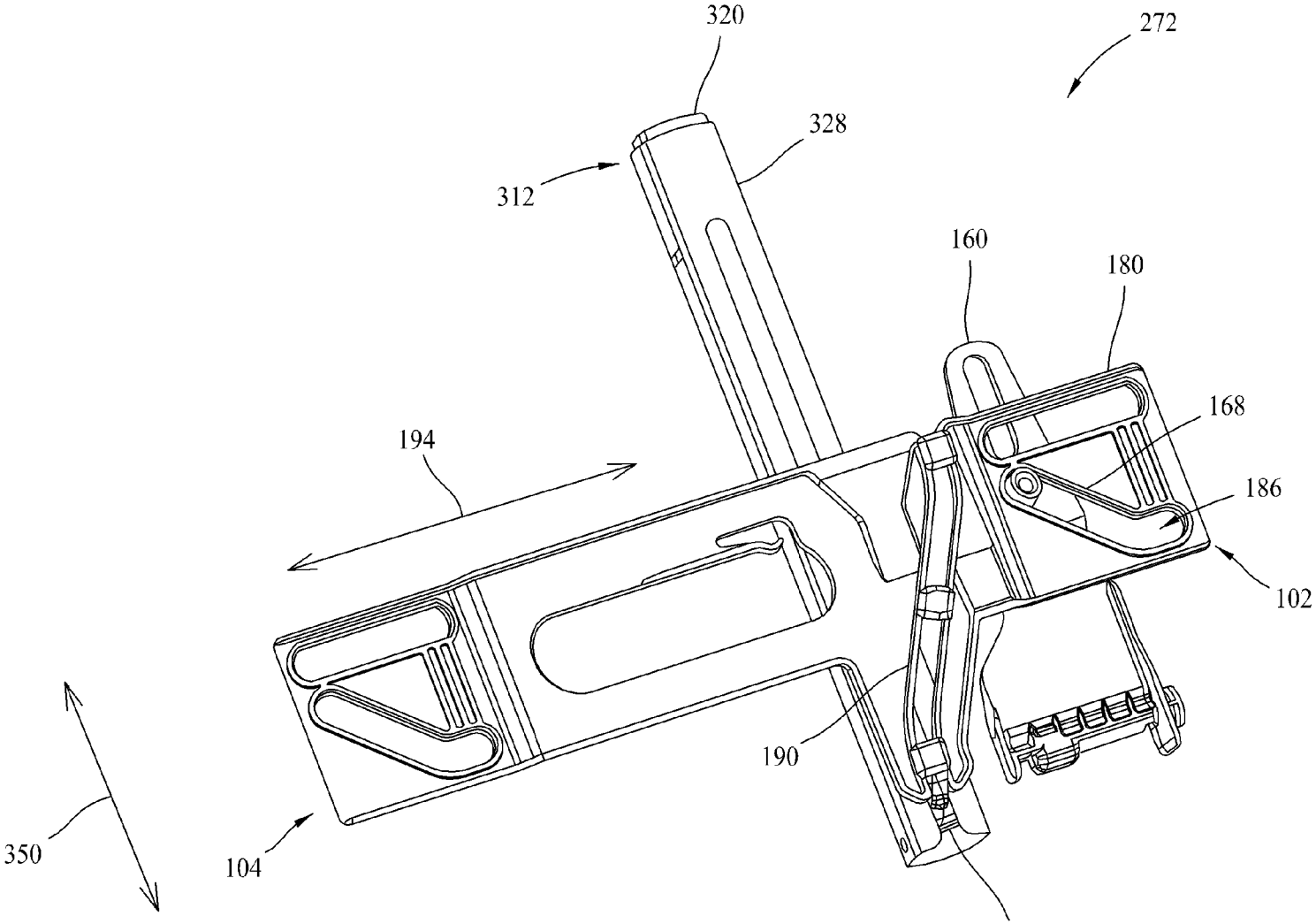
FIG. 28 is a partial rear perspective view of the retractable wheel assembly in the retracted position.
Figure 29:
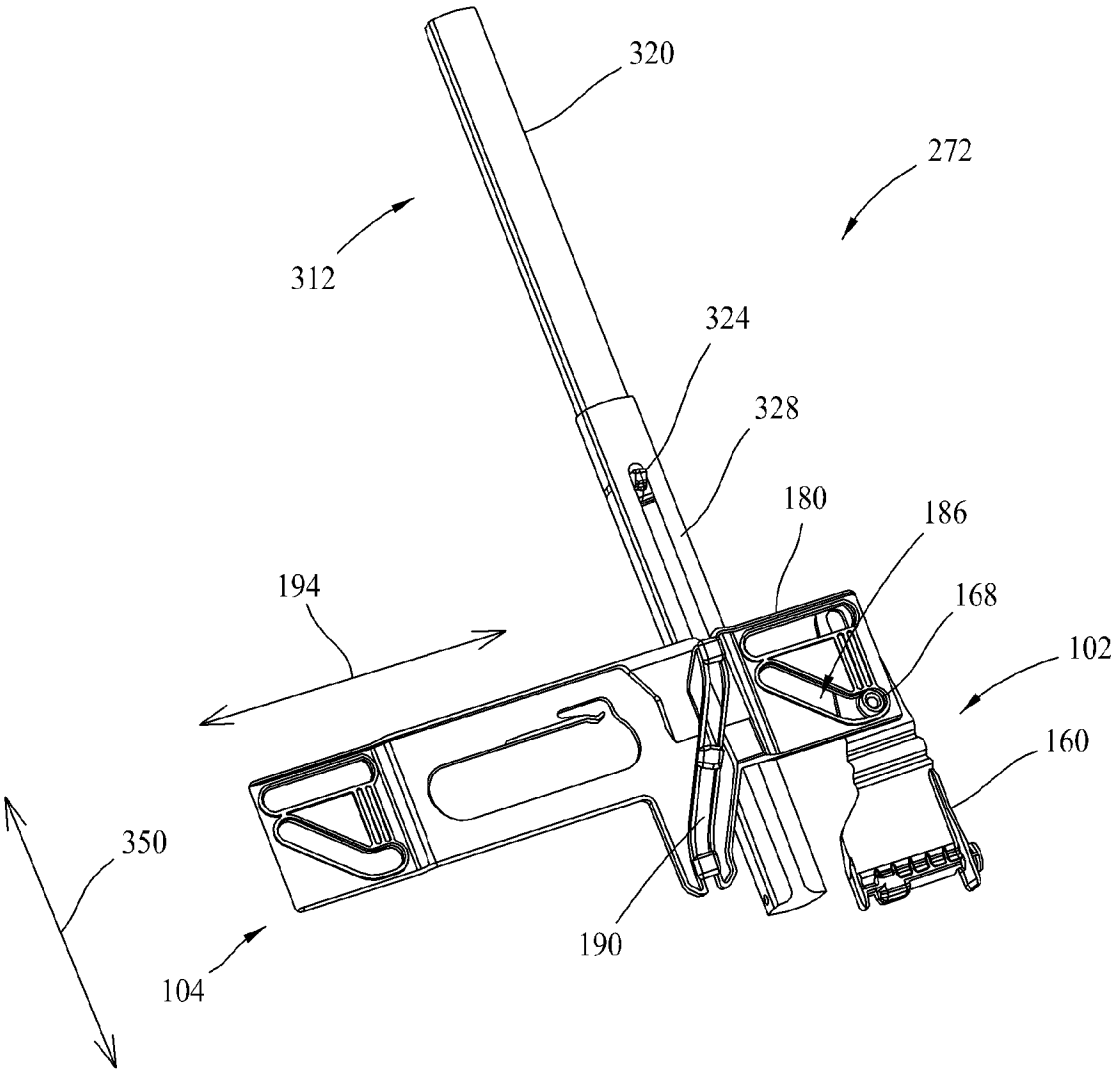
FIG. 29 is a partial rear perspective view of the retractable wheel assembly in the extended position.

When assembled as such, the wheel carrier 160 (and corresponding wheel 82, although wheel 82 is not shown in FIGS. 28-29) of the baggage item 70 move relative to the remainder of the retractable wheel assembly 272 in response to movement of the towing handle system 84 between the extended and retracted positions. More specifically, inner portion 320 of support pole 312 interacts with the actuator 180, which in turn interacts with the wheel carrier 160 such that wheel 82 moves between the extended and retracted positions as a user moves inner portion 320 of support pole 312 between an extended and a retracted position.

When the towing handle system 84 is in an extended position, the wheels 82 are positioned to facilitate towing of the baggage item. More specifically, the wheel carrier 160 is positioned relative to the wheel well 110 of the bottom frame 100 such that the towing wheel 82 partially protrudes from the wheel well 110. In the towing position, the towing wheel 82 is locked in position relative to the bottom frame 100, allowing wheel 82 to roll along a surface and a user to tow the baggage item.

With the towing wheels 82 in the towing position, the piece of baggage can be towed along the ground by tilting the baggage item onto the towing wheels 82 using the handle system 84.

To move the towing wheels 82 into a retracted position, a user slides the handle assembly 87 toward a retracted position, forcing the inner portion 320 of support pole 312 into the outer portion 328 of the support pole 312. The actuator tab 324 enters the support pole channel 190 and moves the actuator 180 from a position near second end 104, along the first axis 194, toward the first end 102. As the actuator 180 moves along the first axis 194, the actuator 180 moves with respect to wheel carrier 160 and the wheel carrier post 168 moves within wheel carrier actuation slot 188. In other words, a user moving the handle assembly 87 along the second axis 350, causes the actuator 180 to move along the first axis 194. Furthermore, the actuator 180 moving along the first axis 194 causes wheel carrier 160 to move along the second axis 350 in the opposite direction as the user is moving the handle assembly 87.

When the wheel carrier 160 is completely retracted, the wheel 82 is positioned within the wheel well 110 of the bottom frame 100. Thus, with the wheel carrier 160 retracted, the towing wheel 82 is also retracted and the piece of baggage can be carried by hand, stored, or otherwise utilized without the risk of the towing wheels marring clothing or upholstery, or the towing wheels being damaged by rough handling. Furthermore, when the towing wheel 82 is in the retracted position, the towing wheels can not easily be seen and the aesthetic appearance of the baggage item 70 is thereby improved.

To return the towing wheels 82 of the baggage item 70 to the towing position, the handle system 84 is simply extended from the baggage item 70. When this is done, the inner portion 320 of the support pole 312 no longer holds the actuator 180 at a position close to the first end 102, but rather, the actuator tab 324 forces actuator 180 toward the second end 104 by moving along the support pole channel 190, which in turn forces wheel carrier post 168 to move within wheel carrier actuation slot 186, forcing wheel carrier 160 to move toward an extended (towing) position along a second axis 350.

FIG. 28 is a partial rear perspective view of the retractable wheel assembly 272 in a retracted position. Inner portion 320 of support pole 312 has been lowered into a retracted position within outer portion 328 of support pole 312. In operation, lowering inner portion 320 causes actuator tab 324 to move to a lower position within support pole channel 190. Due to the curvature of support pole channel 190, moving the actuator tab 324 from an upper portion of support pole channel 190 to a lower portion of support pole channel 190 forces actuator 180 to move along first axis 194 toward first end 102. The actuator 180 sliding toward first end 102 causes wheel carrier post 168 to slide within first wheel carrier actuation slot 186. Since first wheel carrier actuation slot 186 extends obliquely to both the first axis 194 and the second axis 350, and wheel carrier post 168 is configured to slide within first wheel carrier actuation slot 186, moving the actuator 180 along the first axis 194 causes the wheel carrier 160 to move along the second axis 350. Moving wheel carrier 160 upward along the second axis 350 positions the wheel (not shown in FIG. 28) in a retracted position within wheel well 110.

FIG. 29 is a partial rear perspective view of the retractable wheel assembly 272 in an extended position. Inner portion 320 of support pole 312 has been raised to an extended position within outer portion 328 of support pole 312. In operation, raising inner portion 320 moves actuator tab 324 through support pole channel 190 and out of an upper portion of support pole channel 190. When actuator tab 324 moves upwards through support pole channel 190, the actuator 180 is moved along first axis 194 toward second end 104, and wheel carrier post 168 is moved along the second axis 350, perpendicular to first axis 194, to a lower portion of wheel carrier actuation slot 186. Moving wheel carrier post 168 to a lower portion of wheel carrier actuation slot 186 moves all of wheel carrier 160 downward, positioning the wheel (not shown in FIGS. 28-29) in an extended (towing) position.

Figure 30:
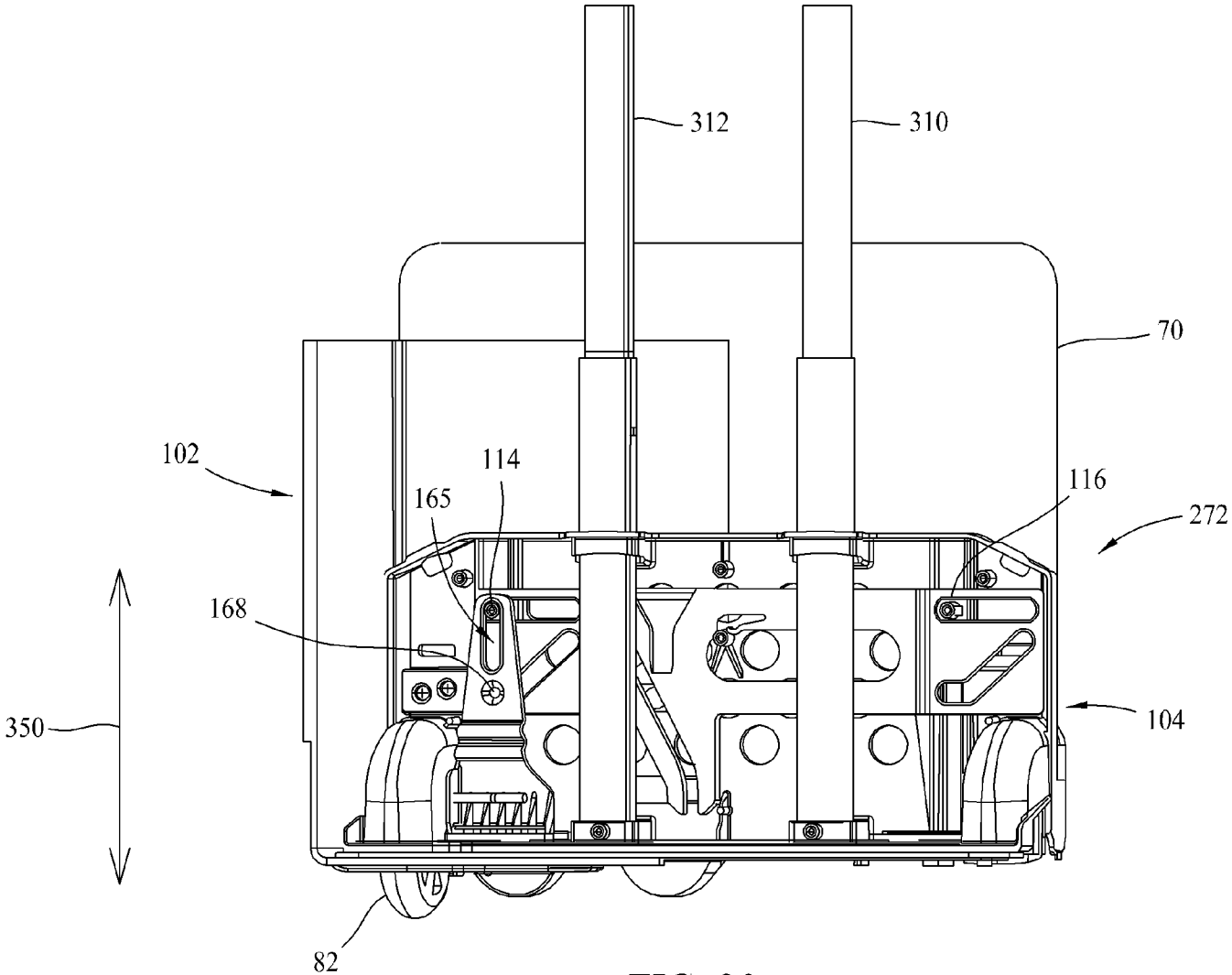
FIG. 30 is another partial assembly view of the retractable wheel assembly in the extended position.

FIG. 30 is another partial assembly view, more specifically a front partial assembly view of the retractable wheel assembly 272 in the extended position and coupled to the baggage item 70 and with handle support pole assemblies 310, 312 installed. Although not shown in FIGS. 28-29, when assembled, a combination of actuator guide post 114 and wheel carrier post 168 maintains an orientation of wheel carrier 160. More specifically, wheel carrier 160, and wheel 82, are orientated such that wheel carrier 160 only moves along the second axis 350, between an extended and a retracted position. In an extended position, as shown in FIG. 30, wheel carrier post 168 is positioned at a lower portion of wheel carrier actuation slot 186.

Figure 31:
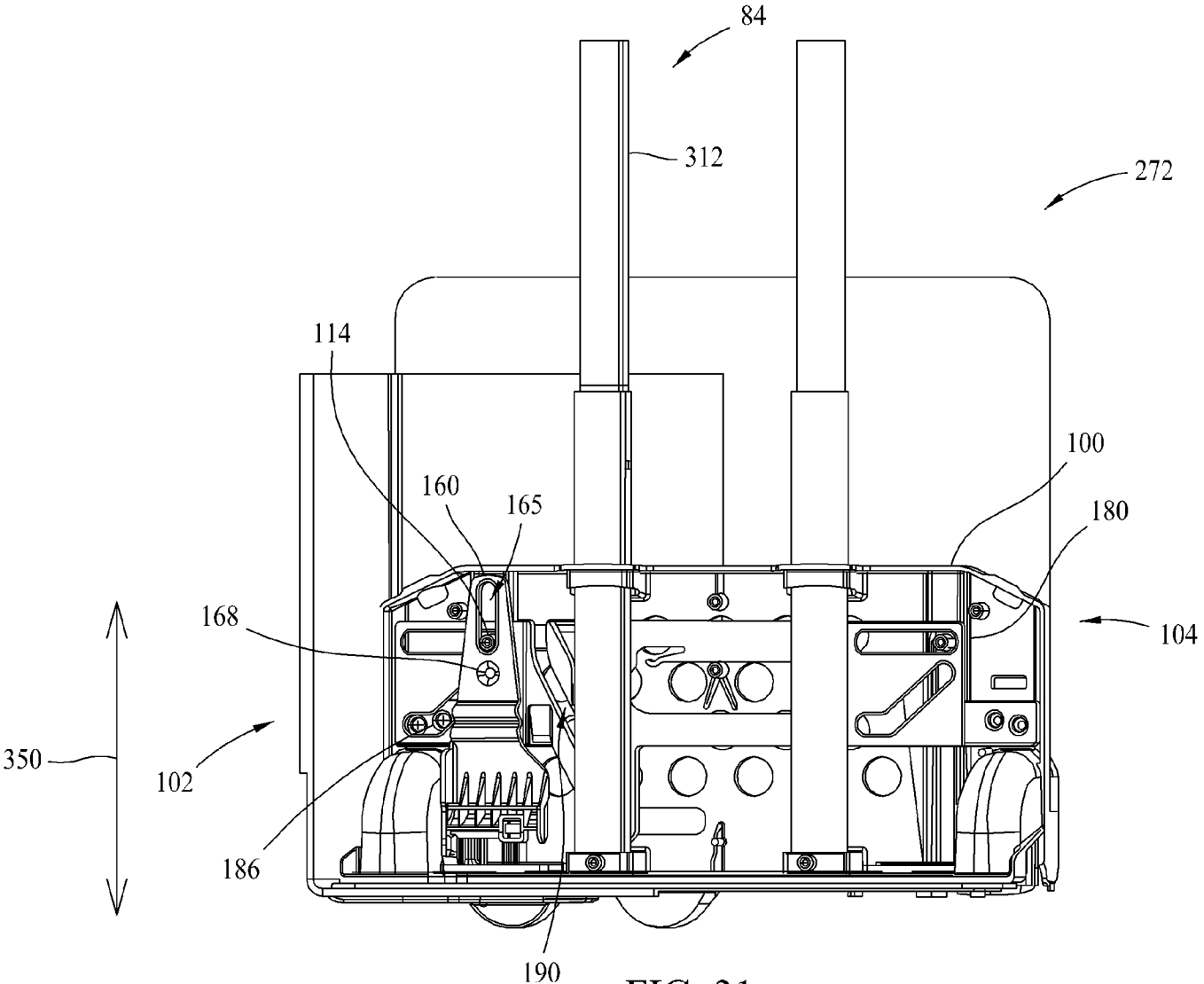
FIG. 31 is similar to FIG. 30 but illustrates the retractable wheel assembly in the retracted position.

FIG. 31 is similar to FIG. 30 but illustrates the retractable wheel assembly 272 in the retracted position. To place retractable wheel assembly 272 into the retracted position, as described above, handle assembly 87 is lowered, pushing actuator tab 324 (not shown in FIG. 31) toward a lower portion of support pole channel 190, which in turn, forces actuator 180 toward the first end 102 of bottom frame 100. As actuator 180 is moved toward the first end 102, wheel carrier post 168 slides along first wheel carrier actuation slot 186, moving wheel carrier 160 upward along the second axis 350. In a retracted position, as shown in FIG. 31, wheel carrier post 168 is positioned at an upper portion of wheel carrier actuation slot 186.

Figure 32:
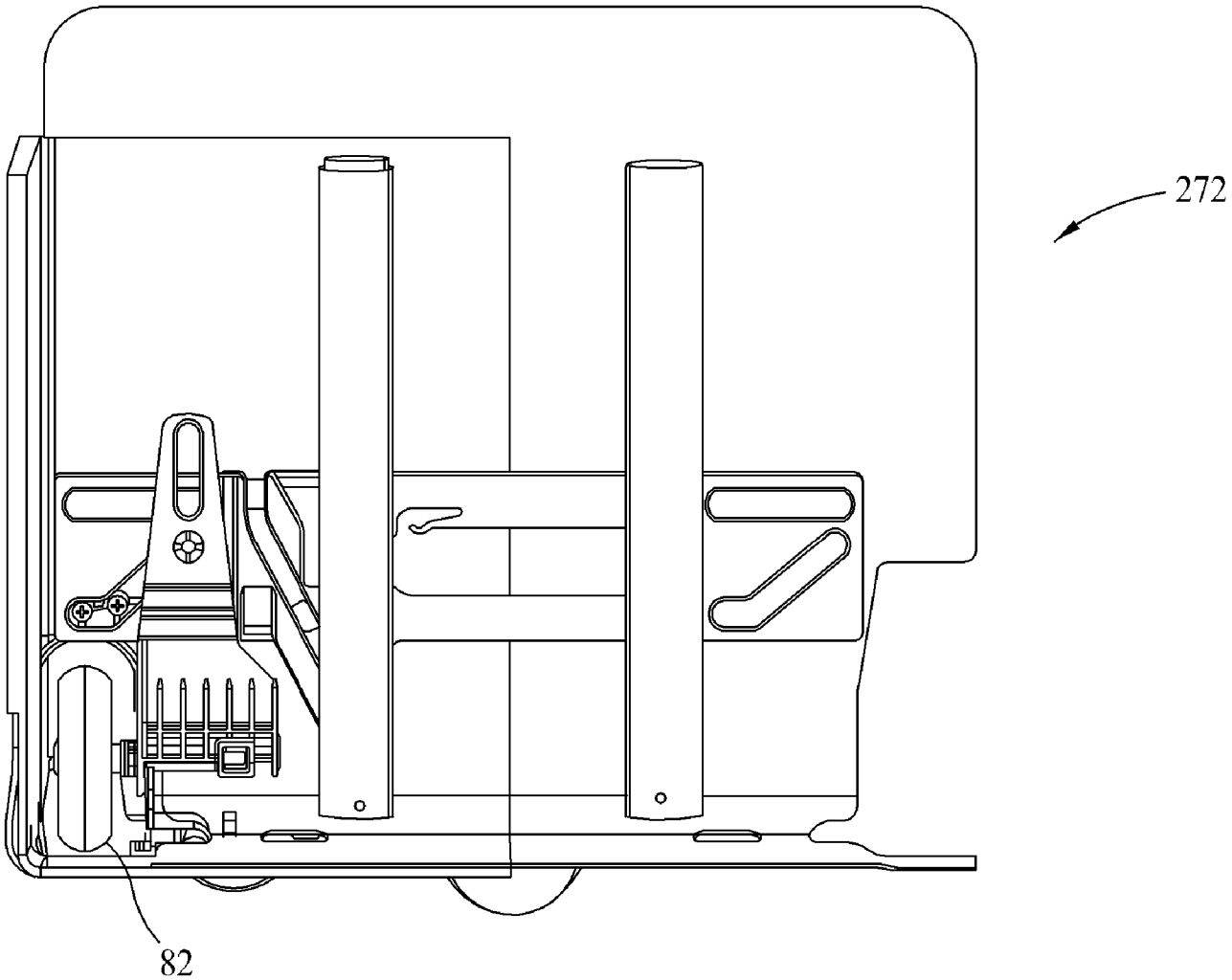
FIG. 32 is similar to FIG. 31 but illustrates the retractable wheel assembly with the bottom frame removed.

FIG. 32 is similar to FIG. 31 but illustrates the retractable wheel assembly 272 with the bottom frame 100 removed. Without wheel well 110 (not shown in FIG. 32) of the bottom frame 100, wheel 82 is visible in a retracted position, within the baggage item 70.

Figure 33:
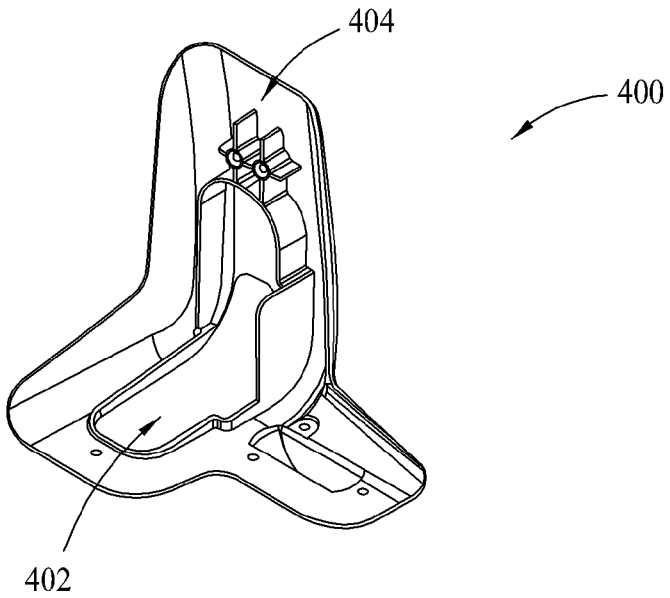
FIG. 33 is a perspective view of an exemplary fender for the retractable wheel assembly.

FIG. 33 is a perspective view of an exemplary fender 400 for the retractable wheel assembly 272. Exemplary fender 400 includes an opening 402 configured such that wheel 82 may fit through the opening 402. Fender 400 also includes fastener openings 404 configured to secure the bottom frame 100 to fender 400. In an exemplary embodiment, a fully assembled baggage item 70 includes the retractable wheel assembly 272 within an interior of the body 72 of the baggage item 70. The baggage item 70 also includes the fender 400, positioned adjacent to an exterior of the body 72 and fastened to the retractable wheel assembly 272.

Figure 34:
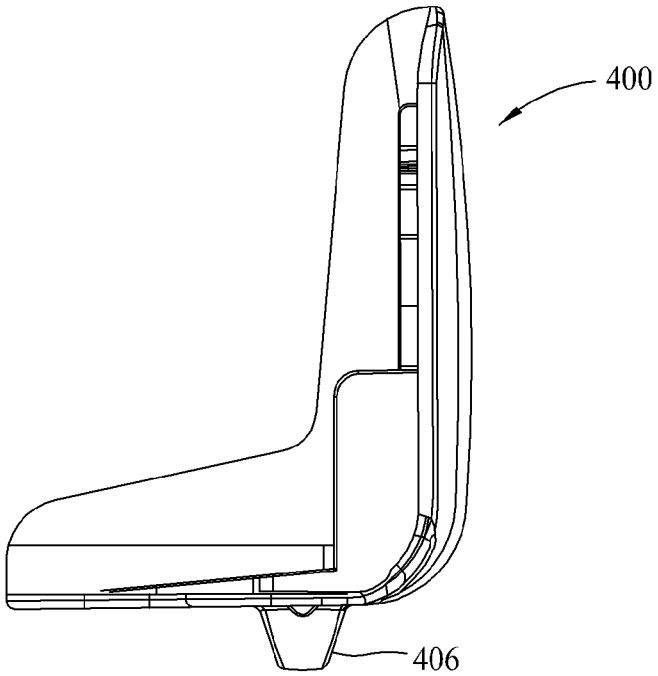
FIG. 34 is a side elevational view of the fender shown in FIG. 33.

FIG. 34 is a side elevational view of the fender 400 shown in FIG. 33. Exemplary fender 400 also includes a bottom foot 406. When wheel assembly 272 is in a retracted position, the bottom foot 406 protects the bottom wall of the baggage item. As described above, when wheel assembly 272 is in an extended position, wheel 82 extends out from the bottom of the baggage item body 72 further than foot 406, enabling the wheel 82 to roll along a surface and a user to tow the baggage item 70.

Figure 35:
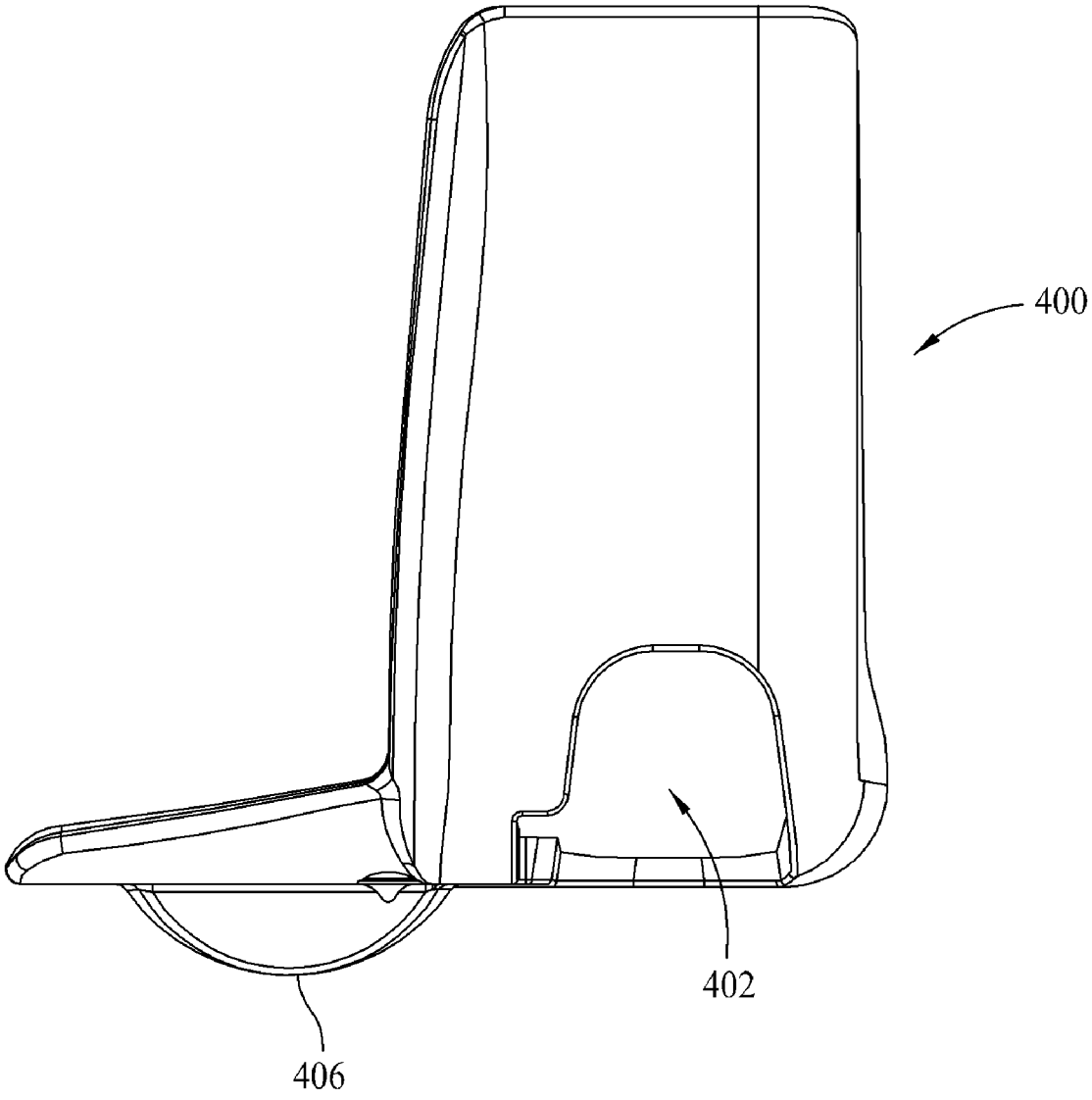
FIG. 35 is a rear elevational view of the fender shown in FIG. 33.

FIG. 35 is a rear elevational view of the fender shown in FIG. 33. Similar components are enumerated by similar reference numerals.

The benefits and advantages of the invention are now believed to be amply demonstrated in the various embodiments disclosed.

As stated in the above embodiments, the retractable wheel assembly 272 includes only four moving parts. The moving parts include the actuator 180, a first wheel carrier 160, a second wheel carrier, and the inner portion 320 of support pole 312. The cover 260 protects the retractable wheel assembly's components, and also retains the components in a proper position. By including a small number of parts, assembly and/or repairs may be accomplished with relative ease and lower cost compared to a more complex assemblies that include a larger number of parts. Also, by including a small number of moving parts, and by not utilizing any sort of spring assisted elements, difficulties associated with complicated mechanics, mechanical misalignment, and failure conditions, are reduced. Furthermore, cost is reduced and reliability increased by having fewer parts to fabricate and assemble.

While the invention has been described in terms of various specific embodiments, those skilled in the art will recognize that the invention can be practiced with modification within the spirit and scope of the claims.

What is claimed is:

1. A towable baggage item comprising:

a body configured to receive and carry objects;

a telescoping towing member connected to the body, the towing member telescoping between retracted and extended positions relative to the body;

two wheel wells coupled to the body;

two wheel assemblies connected to the body proximate the respective wheel wells, each of the two wheel assemblies comprising a wheel and a wheel carrier being movable between stored and towing positions relative to the wheel housing by linearly sliding the wheel carrier relative to the body, the wheel at least partially protruding from the cavity of the wheel well when in the towing position and being positioned within the wheel well when in the stored position;

the wheel assemblies being connected to the towing member in a manner such that the wheel of each of the wheel assemblies moves into the towing position in response to the towing member being moved from the retracted position to the extended position and such that the wheel of each of the wheel assemblies moves into the stored position in response to the towing member being moved from the extended position to the retracted position;

wherein the wheel assemblies are moved into the towing and stored position without a spring assisted element.

* * * * *